US006453712B1

(12) United States Patent
Klosterman et al.

(10) Patent No.: US 6,453,712 B1
(45) Date of Patent: Sep. 24, 2002

(54) METHOD FOR REDUCING CROP LOSSES DURING INGOT ROLLING

(75) Inventors: Lawrence E. Klosterman, Davenport, IA (US); Ray T. Richter, Murrysville; Mark D. Crowley, Pittsburgh, both of PA (US); Andrzej Maslanka, Sydney (AU)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/588,898

(22) Filed: Jun. 7, 2000

(51) Int. Cl.[7] ..... B21B 1/00

(52) U.S. Cl. ..... 72/203; 72/199; 72/229; 72/365.2

(58) Field of Search ..... 72/199, 203, 206, 72/227, 229, 231, 365.2, 366.2

(56) References Cited

U.S. PATENT DOCUMENTS

| | | | | |
|---|---|---|---|---|
| 4,238,946 A | * | 12/1980 | Tsubota | 72/199 |
| 4,344,309 A | | 8/1982 | Matsuzaki | 72/199 |
| 4,387,586 A | * | 6/1983 | Awazuhara et al. | 72/199 |
| 4,486,509 A | * | 12/1984 | Deschapelles et al. | 428/582 |
| 4,730,475 A | * | 3/1988 | Ginzburg | 72/199 |
| 5,947,183 A | | 9/1999 | Schneider et al. | |

FOREIGN PATENT DOCUMENTS

| | | |
|---|---|---|
| JP | 57-199502 | 2/1983 |
| SU | 1704906 A1 | 1/1992 |

OTHER PUBLICATIONS

Mackenzie, I.M., "Influence of Ingot Shape on Yield From Slab Ingots", *Journal of The Iron and Steel Institute*, Apr. 1970, vol. 208, pp. 342–347.

Ikushima, H., et al., "Plasticine Model Tests to Determine Effects of Rolling and Ingot Geometry Variables on Bottom Crop Losses of Slab Ingots", *Ironmaking and Steelmaking*, 1977, No. 3, pp. 176–180.

Patent Abstracts of Japan, Publication No. 55–030381, Publication date Apr. 3, 1980, Kawasaki Steel Corp.

Patent Abstracts of Japan, Publication No. 56–114501, Publication date Sep. 9, 1981, Nippon Steel Corp.

* cited by examiner

*Primary Examiner*—Ed Tolan
(74) *Attorney, Agent, or Firm*—Charles Q. Buckwalter; Kent E. Baldauf; Matthew W. Smith

(57) ABSTRACT

A method and apparatus for reducing crop losses during slab and ingot rolling concerns the formation of a slab ingot having a specially configured or shaped butt end and optionally a head end as well. A special shape is formed by machining, forging or preferably by casting. The special shape at the butt end is imparted during casting by a specially shaped bottom block or starter block. The special shape of the bottom block is imparted to the cast ingot butt end. The specially shaped butt end of a slab shaped ingot is generally rectangular in shape and has longitudinally outwardly extending, enlarged portions, which slope downwardly toward a depressed central valley region. The lateral sides of the enlarged end portions and the depressed valley region carry transversely extending, tapered or curved edges. A similar shape may be imparted to the head end of the ingot at the conclusion of a casting run through the use of a specially shaped hot top mold or by way of machining or forging the cast head end. During subsequent hot rolling in a reversing roughing mill, the specially shaped slab ingot minimizes the formation of overlap and tongue so as to improve material recovery by reducing end crop losses and to increase rolling mill efficiency by increasing metal throughput in the mill.

8 Claims, 22 Drawing Sheets

METHOD FOR REDUCING CROP LOSSES DURING INGOT ROLLING

BACKGROUND OF THE INVENTION

1. Field of the Invention

The present invention relates generally to the rolling of metal ingots and, more particularly, to methods and apparatus for increasing ingot rolling yields and rolling mill efficiency by minimizing end crop losses in the rolling of flat slabs, for example. This favorable increase in material yield and rolling efficiency is achieved by a novel slab ingot end geometry and formed in one or both ends of the ingot, preferably during ingot casting. The invention is most advantageously applied to the manufacture of aluminum mill products.

2. Description of the Prior Art

A widely used method of manufacturing aluminum plate, sheet and foil products initially involves the vertical semi-continuous casting of slab-shaped ingots which includes a bottommost leading end, referred to in the art as the "butt" of the ingot. The butt is formed as the liquid metal solidifies on the movable bottom block or starter block which is in the open bottom of the mold. After solidification, the butt assumes the shaped geometry of the bottom block. The bottom block continuously moves downwardly and away from the mold as the solidified metal ingot exits at the open end of the mold at the location previously occupied by the bottom block. The cross-section of the vertically cast ingot of metal assumes the horizontal cross-sectional geometry of the mold. The sidewalls of the mold and the sidewalls of the solidified ingot exiting the mold are sprayed with water to increase the solidification rate. This casting technique is referred to as direct chill or "DC" casting, all of which are well-known in the art. After the cast ingot has reached a desired length, the molten metal flow to the mold is terminated and the solidified ingot is removed from the casting pit for further processing. It is common practice in commercial DC casting to pour a plurality of ingots in a casting run from a plurality of side-by-side molds. Of course, it will be readily understood by those skilled in the art that the present invention is suitable for use in conjunction with other semicontinuous casting systems such as, for example, electromagnetic casting (EMC casting).

The DC or EMC cast ingots may then be scalped to remove as-cast surface imperfections and homogenized by heating in a furnace to provide a uniform chemistry across the ingot cross-section prior to rolling. In order to process the thus treated ingots to useful end products, such as sheet, plate, foil or the like, the ingots are heated to a desired rolling temperature and subjected to a plurality of hot rolling roughing passes in a slabbing mill. Such rolling mills conventionally use one or more reversing roughing mill stands.

The free surfaces existing on an ingot or slab of finite width, thickness and length allow nonuniform rolling deformation to occur in the length and width dimensions during hot rolling. This nonuniform deformation causes an elongation of the slab in the center region thereof which forms a convex, longitudinally extending "tongue" condition at the ends thereof, particularly in aluminum slabs which are roughed down in reversing mills, usually without the use of side or edge rolls. Formation of a tongue condition is, however, not uncommon in the rolling of aluminum even in mills equipped with edge rolls. The aforesaid nonuniform deformation phenomenon is more severe in the length direction of the slab leading to another condition referred to in the art as "fold over", "overlap" or "alligatoring". These objectionable conditions at the ends of the slab grow worse as rolling continues and must eventually be removed by a crop shear to permit further rolling to continue. Some mills have a limitation on the crop length, due to crop shear equipment limitations, and must take two or more crops to crop off the necessary length dictated by the overlap and tongue deformations. In some cases, it has been observed that severe slab end elongation may occur during the early rolling passes which would ideally call for removal by intermediate end cropping but may not be possible if the slab thickness is too great for the crop shear. In such cases, the end deformation then worsens, causing additional end crop losses as rolling continues. It is known that less cropping length provides obvious metal recovery benefits and/or operational benefits if cropping can be postponed to later rolling operations. In addition, it is known that the overlap or alligatoring phenomenon may sometimes, in severe cases, cause the upper and lower surfaces of the slab to flair upwardly and downwardly beyond the ends of the slab at the horizontal centerline. This overlap must be sheared to allow rolling to lower thicknesses for safe entry into continuous mill equipment. In addition, the flared ends of the "alligator" move or otherwise damage table roll surfaces and work rolls which disrupts production. It is also well-known that the overlap causes an internal lamination crevice in the metal which grows during rolling and will result in unsound plate and sheet products unless it is removed by crop shearing.

Previous experimental work has been undertaken by Applicants' colleagues in an effort to reduce slab rolling cropping losses by tapering the ends of slab ingots by machining away the upper and lower transverse edges of the ingot so as to form a somewhat truncated, arrow-shaped end profile when the ingot is viewed in a longitudinal side view. In-house tests were run on ingots having 30°, 38° and 45° tapered ends. The optimum shape was noted to be between a 30° and 34° taper to reduce the "foldover", "overlap", "alligatoring" problem. This 30°–34° deep taper achieved by machining represents an added cost to the manufacturing process and also causes some material loss. In addition, while the "alligatoring" problem was reduced somewhat by the machined tapered ends, the "tongue" elongation problem, i.e., a convexly shaped protruding end (in plan view) was still present.

A process for preventing the growth of "fish mouth" overlap is proposed in U.S. Pat. No. 4,344,309 to Matsuzaki dealing with the rolling of steel slabs. Recesses are formed at the ends of the steel slab by partially rolling the ends of the slab in several short reverse rolling bites which are said to minimize the formation of overlaps in steel slabs. Recesses are also formed in the widthwise direction at opposite side edges of the ends of the slab by vertically extending side rolls in the same manner in an attempt to prevent the formation of fishtails. Rolling then progresses to reduce the steel slab, with additional side edge rolling, with the formation of intermediate recesses required. This elaborate rolling schedule which is said to minimize the formation of overlaps and fishtails in steel slabbing requires additional rolling time and, thus, adds cost to the end product. In addition, many slab roughing mills, particularly in the aluminum industry, are not equipped with the vertical side rolls required in U.S. Pat. No. 4,344,309. The literature also suggests the shaping of steel ingot ends by forming a truncated pyramid shape at the bottom end of an ingot to minimize cropping losses while employing edge rolling of steel slabs. Once again, these proposals are not applicable to aluminum roughing mills which do not employ side or edge rolling using vertically oriented rolls.

The present invention overcomes the shortcomings of the prior art by providing a method, apparatus and shaped slab ingot for reducing hot mill end crop on at least the butt end of a slab which greatly improves mill productivity and metal yield, particularly in the hot rolling of aluminum mill products.

The present invention contemplates a method, a product and apparatus which provide an ingot having a special configuration formed on at least the butt end of an ingot, preferably formed during casting thereof. The specially configured slab ingot provided by the present invention minimizes the occurrence of overlapping/alligatoring as well as tonguing during slab rolling, thus reducing the cropping losses to increase mill productivity and metal recovery.

The invention further provides a specially shaped bottom block used in the slab ingot casting to provide a shaped butt end in the ingot to minimize overlapping/alligatoring and tongue formation during subsequent hot rolling/slabbing. Controlling the end shape of the ingot in accordance with the present invention provides easier cropping due to the fact that the rolled ingot is thinner at the time when cropping is required. Still further, the present invention contemplates the use of a "hot top" type mold to place on the mold at the conclusion of the ingot casting pour to form a special shape at the head end of the ingot similar to the shape at the butt end. Hence, the common rolling crop loss problems relating to tongue and overlap/alligatoring are minimized at the head end as well. Still further, the present invention provides a slab ingot having at least one end specially shaped by casting or by machining to reduce the formation of tongue and overlap problems during rolling.

SUMMARY OF THE INVENTION

The present invention contemplates an apparatus comprising a specially shaped bottom block or starter block for imparting a like shape to the butt end of a direct chill (DC) or electromagnetic cast (EMC) cast aluminum slab ingot. The invention also is directed to a slab ingot having one or both of its ends specially shaped, either by molding and/or by machining. The invention further includes a process or method for reducing end crop losses in the rolling of metal slab ingots by providing a slab ingot having at least one specially shaped end by molding and/or machining the special shape. The invention finds particular utility in the aluminum metal industry.

Briefly stated, an apparatus according to the present invention includes a bottom block or starter block for forming the butt end of a slab ingot in a semicontinuous casting station. The bottom block has a generally rectangular shape in plan view. When taken in a cross-sectional, longitudinal side view, the bottom block has a raised central region which tapers downwardly at opposed, transversely spaced ends thereof to form downwardly extending, depressed regions at opposed transverse ends. The raised central region and the transversely spaced depressed end regions of the bottom block are tapered at opposed side portions when viewed in a narrow edge side elevation to provide planar surfaces which intersect along a common line extending longitudinally along the long dimension of the block. In place of flat, planar surfaces forming the tapers, the tapers also may be formed by curved surfaces.

After ingot casting, the above-described specially shaped bottom block imparts a substantially like special shape to the butt end of the cast slab ingot. Those skilled in the art will appreciate that the solidified metal will shrink and curl away from the mold and assume a slightly dimensionally different shape. More specifically, if the bottom block shape is considered as the negative, the butt end of the ingot cast therein may be considered as the positive image thereof. Thus, the butt end of the ingot has longitudinally outwardly extending, enlarged portions which slope downwardly to a depressed central valley region. The lateral sides of the enlarged end portions and the depressed valley region carry tapered or curved edges. In addition, a similarly shaped hot top type mold may be employed to form the same or similar special shape at the head end of the ingot. At the conclusion of the casting run, when employing this embodiment, the molten metal is allowed to fill the specially shaped top mold to provide a slab ingot having a head end with a shape the same as, or similar to, the butt end. In this manner, cropping losses due to tongue and overlap problems are minimized at both ends of the rolled slab.

The present invention also contemplates the forming of the above-described special end shape to one or both ends of a conventionally cast slab ingot by machining or forging or like metal deformation technique after casting. While the machining or forging operation represents an additional cost element over in situ casting, it is believed that it will be more than offset by the savings realized through increased material recovery due to reduced end crop losses and increased rolling mill efficiency.

A process of the present invention includes the step of providing a slab ingot having at least one shaped end, preferably the butt end. The shaped end(s) has at least two longitudinally outwardly extending enlarged end portions at opposed, transversely spaced-apart locations adjacent to opposed edge or gage faces of the slab ingot having a region or regions of reduced longitudinal dimension or depressed valley therebetween. The shaped end(s) of the ingot also include upper and lower tapers transversely extending across the width of the slab into, respectively, from an upper rolling face and a lower rolling face of the ingot across the outwardly extending enlarged end portion and also across the depressed valley region of reduced longitudinal dimensions. The specially shaped end portions of the slab ingot are preferably formed by casting using a like-shaped end block and hot top mold. Alternatively, the specially shaped end may be formed by machining or forging a conventionally cast slab ingot. The presently preferred method of the invention, however, includes the step of providing a slab ingot with the special shape formed during casting by way of a shaped bottom block. The head end of the slab ingot may be left flat, as in conventional casting practice, or it may be subjected to a forming step through the use of a shaped mold, similar to a hot top mold, to form the above-described special shape at the head of the ingot at the conclusion of the casting run. In addition, the present invention contemplates that the head end, if left flat after casting, may be machined or forged to approximate the special shape of the butt end, including the enlarged end portions with the depressed intermediate valley therebetween, as well as the tapers transversely extending from the upper and lower rolling faces of the ingot. Alternatively, the head end and/or the butt end of the slab ingot, if left flat after casting, may be machined or forged or rolled partially only to provide transverse tapers across the upper and lower rolling faces (without the enlarged end portions) so as to minimize the overlapping problem at the head end of the rolled ingot.

A process of the present invention may also include the step of conducting an intermediate end cropping of the partially rolled slab in which the crop shear imparts a special shape to the slab. The cropped end includes enlarged end portions and a depressed central valley portion so as to minimize the formation of a tongue during subsequent rolling.

The process according to the present invention concludes by hot reverse rolling the slab ingot in a plurality of reducing passes through a hot reversing breakdown mill to reduce the thickness and increase the length of the ingot whereby the specially shaped slab ingot end(s) minimizes the formation of overlap and tongue so as to improve material recovery by reducing end crop losses and to increase rolling mill efficiency by increasing metal throughput.

These, as well as other advantages and features of the present invention, will become more readily apparent when reference is made to the appended drawings when taken in conjunction with the following detailed description.

BRIEF DESCRIPTION OF THE DRAWINGS

FIG. 7(*b*) is a photograph of the butt end of the ingot of FIGS. 4–6 after seven rolling passes, as in FIG. 7(*a*) but taken at a slightly different location angle;

DETAILED DESCRIPTION OF THE INVENTION

Figure 2:
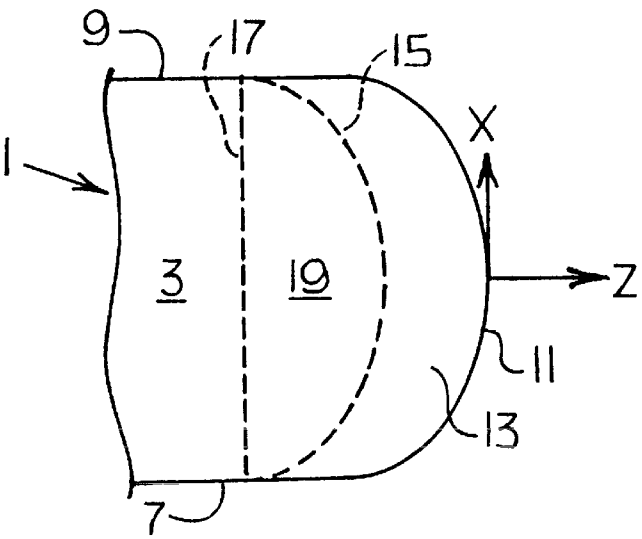
Fig. 2 Prior Art
FIG. 2 is a fragmented plan view of the top rolling face of the slab of FIG. 1 showing the development of conventional, convex tongue deformation.
Figure 3:
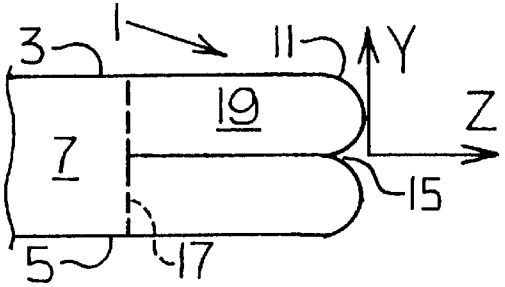
Fig. 3 Prior Art
FIG. 3 is a fragmented side view of the edge or gage face of the slab of FIGS. 1 and 2 showing the development of conventional overlap rolling deformation at the distal end thereof.
Figure 1:
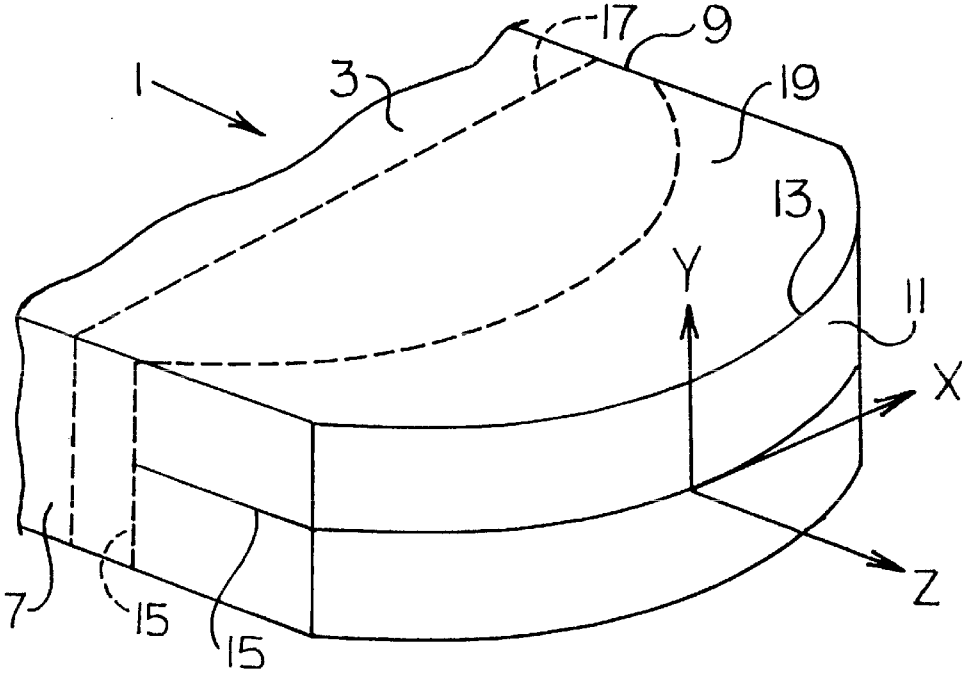
Fig. 1 Prior Art
FIG. 1 is a fragmented, simplified, perspective view of a slab end showing the formation of conventional tongue and overlap rolling deformations.

In order to better understand the details of the invention, it will be helpful to define the spatial and directional relationships involved in ingot casting and rolling, as well as the terminology used herein. These spatial and directional relationships will be explained with reference to FIGS. 1–3. FIGS. 1–3 schematically depict one end of a conventionally cast slab shaped ingot, generally designated by reference numeral 1, after it has been subjected to a plurality of rolling passes in a reversing, roughing mill. FIG. 1 is a perspective view which identifies the three-dimensional axes "X," "Y" and "Z". The "X" axis identifies a transverse width direction of the slab ingot 1. The "Y" axis identifies the vertical height or thickness direction of the ingot 1. The "Z" axis represents the longitudinal direction of the ingot 1, which is coincident with the rolling direction.

The slab ingot 1 has an upper or top rolling face 3 and a lower or bottom rolling face 5 which are parallel to or coincident with a plane passing through the "X"–"Z" axes. The ingot 1 also has a first edge or gage face 7 and a transversely spaced second edge or gage face 9, both of which lie in parallel planes defined by the "X"–"Z" axes. The ingot 1 also has a butt end which lies substantially in the plane of the "X"–"Y" axes in the conventional as-cast condition (not shown in FIGS. 1–3). As is well-known in the art, the butt end of a slab ingot is formed by a starter block or bottom block which is generally flat or slightly concave which imparts a flat or slightly convex shape to the butt end of the ingot after metal solidification. The ingot 1 has a head end (not shown in FIGS. 1–3) which is formed at the conclusion of the casting run, and it, too, assumes a generally flat or concave surface, nearly parallel to the plane of the "X"–"Y"axes.

In the typical case of reverse roughing of a conventional slab-shaped aluminum ingot 1 as depicted in FIGS. 1–3, several rolling deformations begin to appear in the end 11 of the ingot after a number of passes in the mill. An outwardly extending, convexly shaped "tongue" 13 is formed in the "X"–"Z" plane (FIG. 2) and an "overlap" 15 develops in the "Y"–"Z" plane (FIG. 3).

Figure 4:
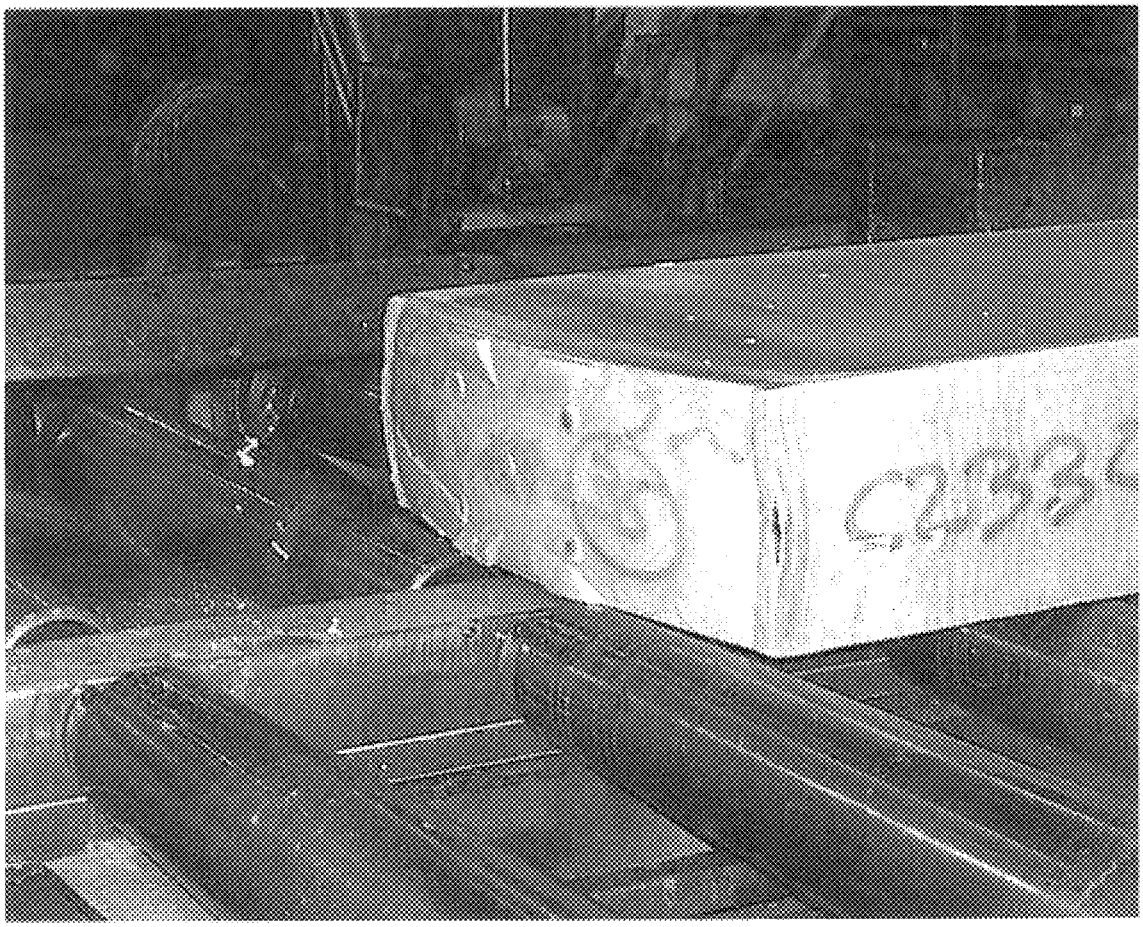
FIG. 4 is a photograph of a butt end of a conventionally cast slab ingot after one pass in a hot reversing mill.
Figure 5:
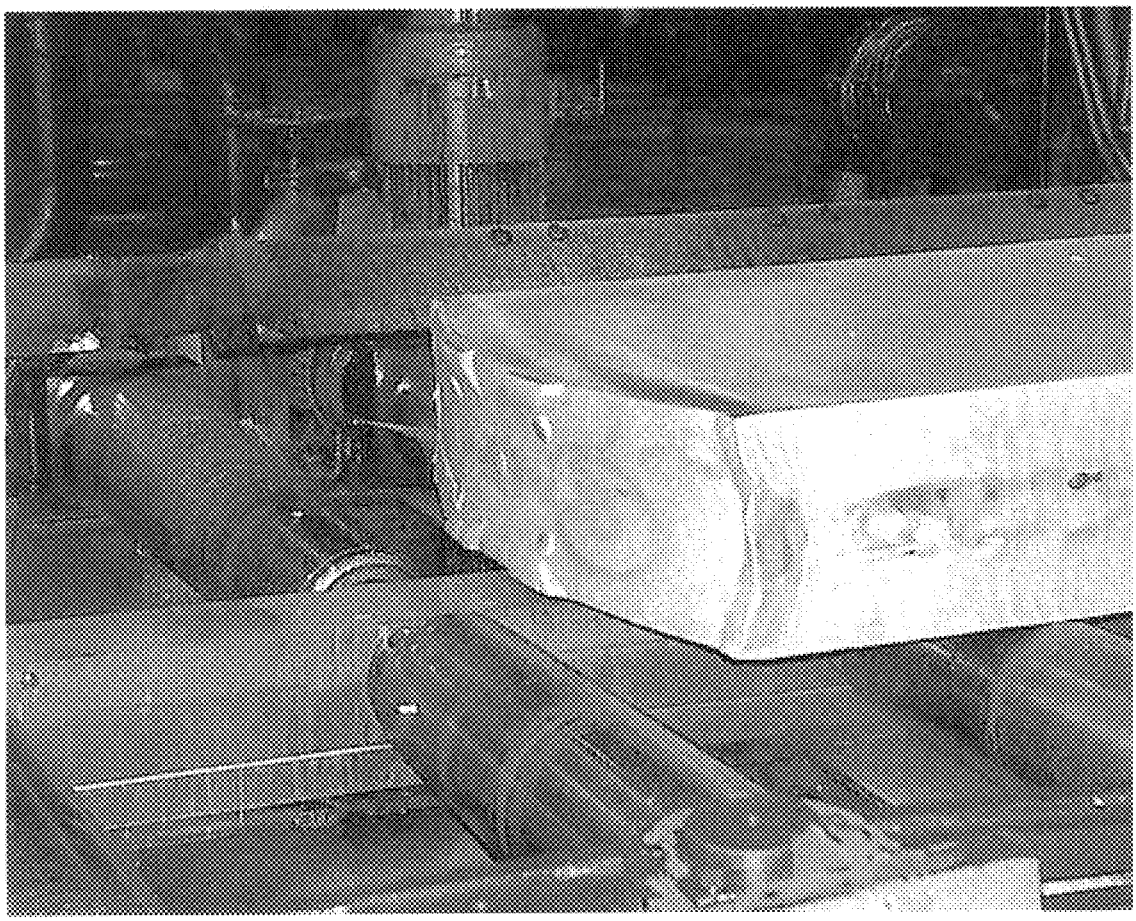
FIG. 5 is a photograph of the butt end of the ingot of FIG. 4 after three rolling passes in the hot reversing mill.
Figure 6:
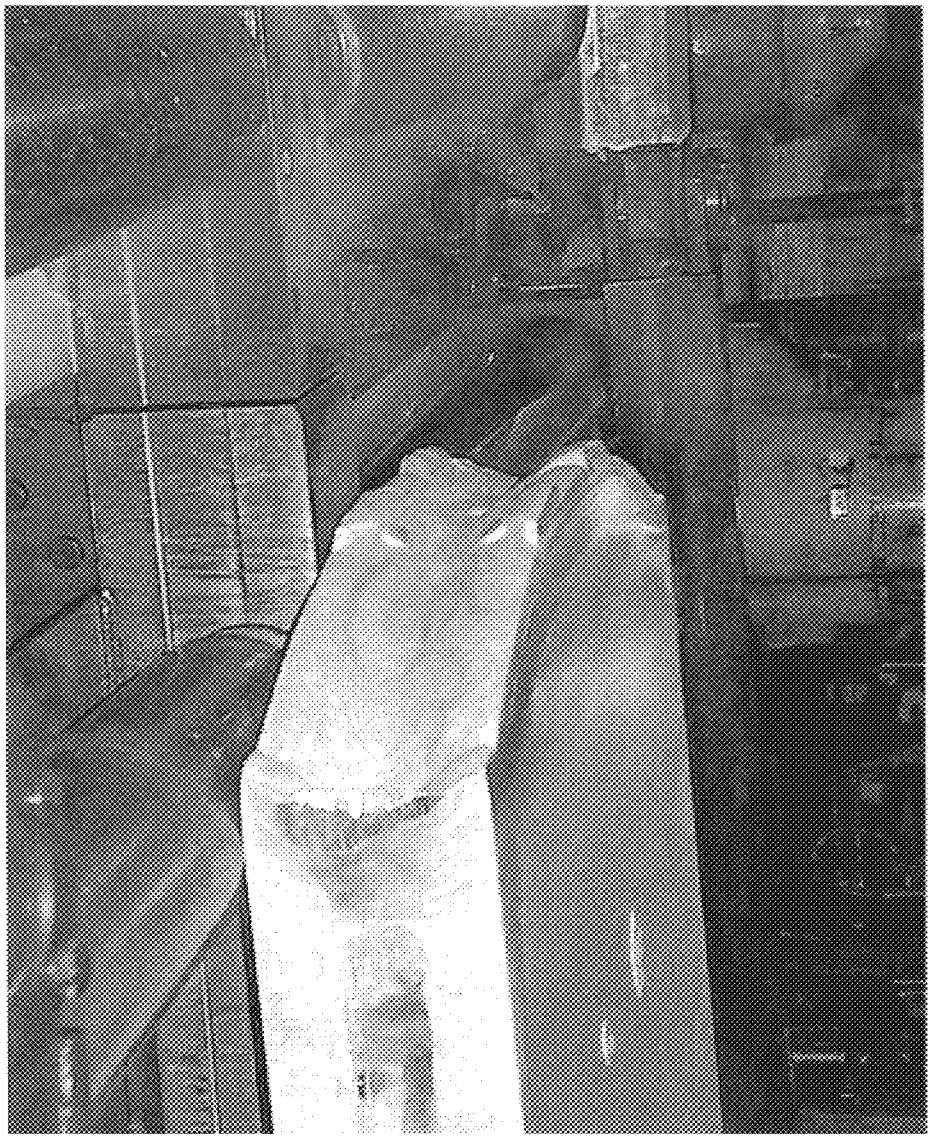
FIG. 6 is a photograph of the butt end of the ingot of FIGS. 4 and 5 after five rolling passes.
Figure 7A:
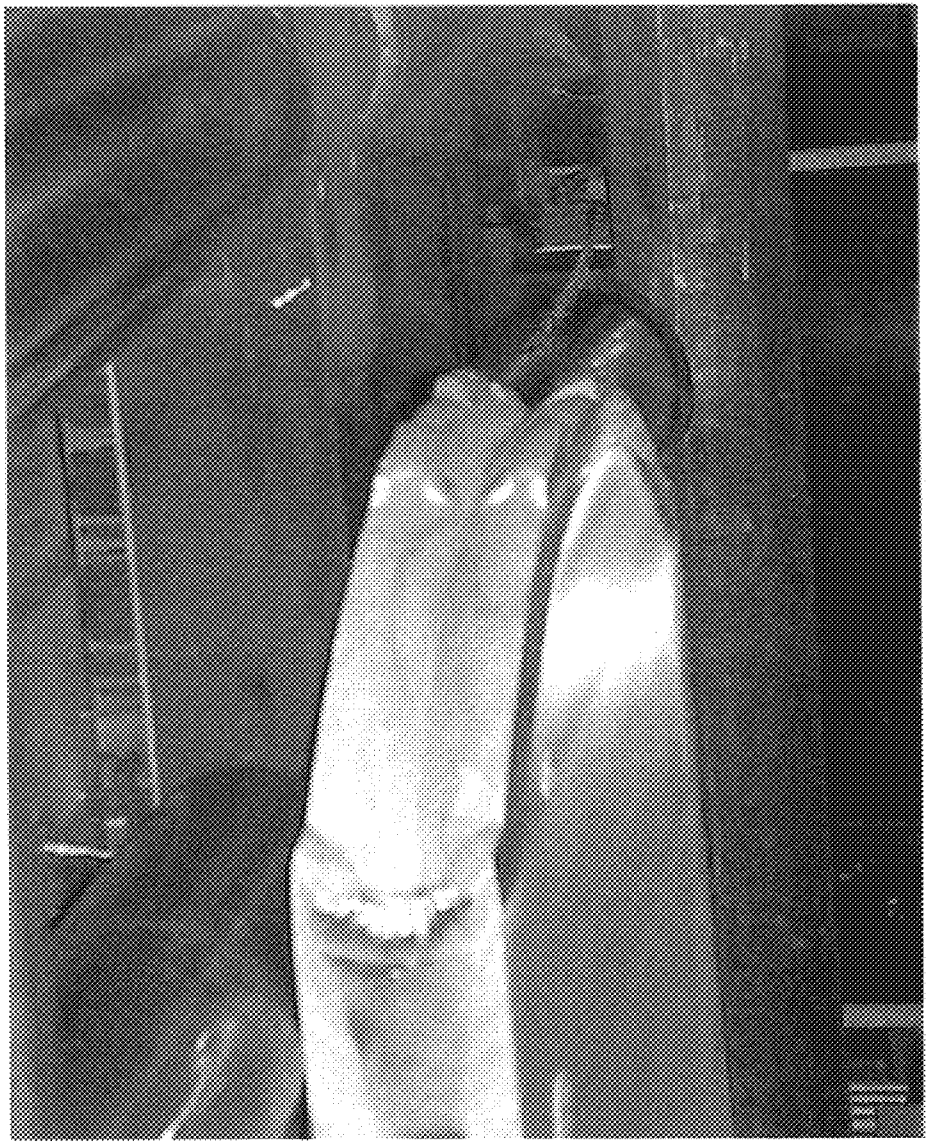
FIG. 7(*a*) is a photograph of the butt end of the ingot of FIGS. 4–6 after seven rolling passes.
Figure 7B:
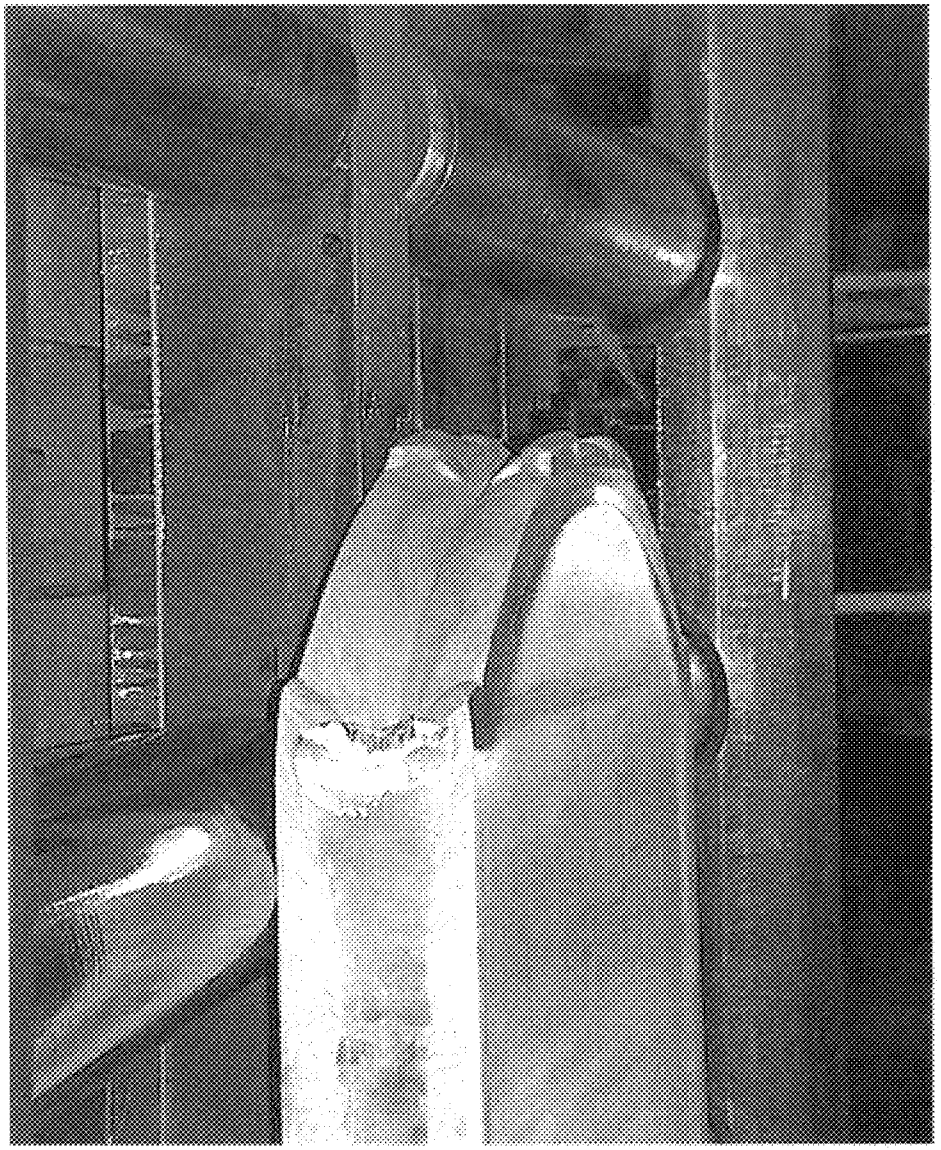
Figure 8:
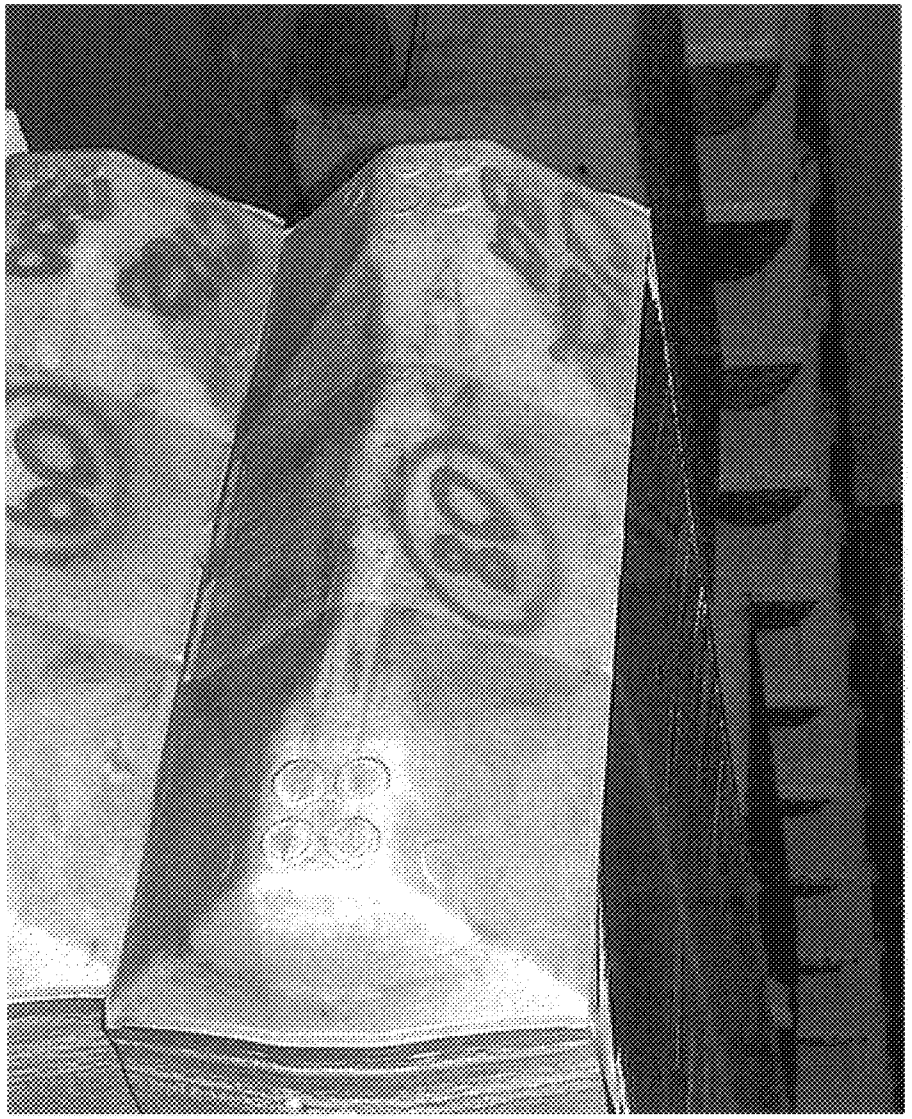
FIG. 8 is a photograph of the butt ends of two vertically stacked slab ingots showing the specially shaped end formed therein according to the present invention.

The development of the tongue 13 and overlap 15 rolling deformations are shown sequentially in the photographs reproduced in FIGS. 4–7 of a 20" thick×54" wide conventionally cast slab-shaped ingot of 1050 aluminum alloy (Aluminum Association designation). FIG. 4 depicts the slab after one rolling pass and shows the butt end substantially in the as-cast configuration. FIGS. 5, 6 and 7 show the development of the tongue and overlap deformations after the third, fifth and seventh rolling passes, respectively.

During the reverse rolling/roughing process, similar tongue and overlap deformations also occur at the head end of the ingot but to a slightly lesser degree with respect to the tongue condition than that occurring at the butt end. This is due to the fact that the butt end is relatively flatter than the conventional, convex shaped butt end and because the butt end undergoes one additional entry pass in the mill compared to the head end.

After a number of rolling passes in the reversing mill, for example, after seven passes, the ingot has been reduced from 20 inches to about 5½ inches in thickness ("Y" direction). The ends of the rolled slab carrying the tongue 13 and overlap 15 deformations are then removed or "cropped" by shearing to square off the slab ends so that the slab can be further processed and reduced by further rolling to about 1 inch in thickness.

As depicted in FIGS. 1–3, the tongue and overlap deformations extend a considerable distance in the rolling direction along axis "Z". The objectionable metal is removed along a crop shear line 17 to provide a slab which is free of the overlap seam 15 and tongue 13 deformations. A cropped end 19, extending from the crop shear line 17 to the butt end 11, is then removed from the slab 1. A similar crop is made by the shear at the head end. Thus, these cropped ends 19 represent a loss of material in the rolling process and a reduction in metal throughput. In addition, a number of commercial rolling mills utilize crop shears which have a limitation on the length of crop which may be made. Oftentimes the distance of the required crop shear line 17 from the slab end exceeds the equipment capabilities in which the crop shear length limitation is exceeded. In such situations, several crops of smaller increments must be made. This multiple shearing adversely affects rolling mill efficiencies, in addition to the end crop losses. Of course, cropping can occur at different times in the rolling process depending on various factors, including alloy, pass schedule, mill and shear design, to mention a few, all well-known to those skilled in the art.

In order to reduce end crop losses and increase rolling mill efficiencies, a specially shaped ingot end has been developed in accordance with the present invention. The specially shaped ingot end configuration is depicted in FIGS. 8 and 13–16. Specially shaped bottom blocks, also referred to in the art as starter blocks, for producing the described ingot end configuration in accordance with the invention are shown in FIGS. 17–23.

With specific reference to FIGS. 13–16, a slab shaped ingot 20 has a specially shaped butt end 22 according to one presently preferred embodiment of the present invention. The shaped butt end 22 includes two longitudinally extending (in the "Z" direction) enlarged portions 24 at opposed, transversely spaced-apart locations, adjacent to the opposed edge or gage faces 7' and 9'. A depressed valley 26 of reduced longitudinal dimension ("Z" direction) extends transversely ("X" direction) between the two enlarged portions 24. The enlarged portions 24 include intermediate sections 25 which slope inwardly (in the "Z" direction) to meet the depressed valley region 26. Alternatively, the intermediate section 25 can slope from opposite portions 24 at a smaller angle and meet at or nearer to the longitudinal center line of the slab and, thus, form a slightly different configuration for the depressed valley 26. The above-described ingot shape employing the two enlarged portions 24 with the intermediate valley 26 counteracts the formation of a convex tongue 13 (FIGS. 1–2) during rolling of the slab shaped ingot 20.

Concurrently, the overlap deformation problem 15 (FIGS. 1–3) is counteracted by the use of transverse tapers 30 and 32 formed on the butt end 22 of the slab shaped ingot 20. The transverse tapers 30 extend from the upper rolling face 3' and from the lower rolling face 5' to end faces 28 of the enlarged portions 24. The transverse tapers 30 are formed at an angle a defined by the angle developed between the plane of the rolling faces 3' and 5' and the plane of the adjacent taper 30, see FIG. 14. The angle $\alpha$ lies within a presently preferred range of about 30° to about 70°. An angle $\alpha$ of 50° is presently preferred in rolling aluminum slab shaped ingots measuring about 50" wide and about 20" thick.

Transverse tapers 32 extend from the upper and lower rolling faces 3' and 5' outwardly in the longitudinal direction to intersect an end face 27 of the valley portion 26. The transverse tapers 32 are formed at an angle $\beta$ defined by an angle developed between the plane of the rolling faces 3' and 5' and the plane of an adjacent transverse taper 32, see FIG. 14. The angle $\beta$ preferably lies within a range of about 30° to about 70°. An angle $\beta$ of about 60° has been found suitable in the practice of the present invention in rolling aluminum slab ingots of the size alluded to above. The intermediate sloped sections 25 also have tapered upper and lower faces 34 which slope downwardly from the tapers 30 of the enlarged end portions 24 to intersect and blend with the transverse tapers 32 of the valley portion 26.

Figure 17:
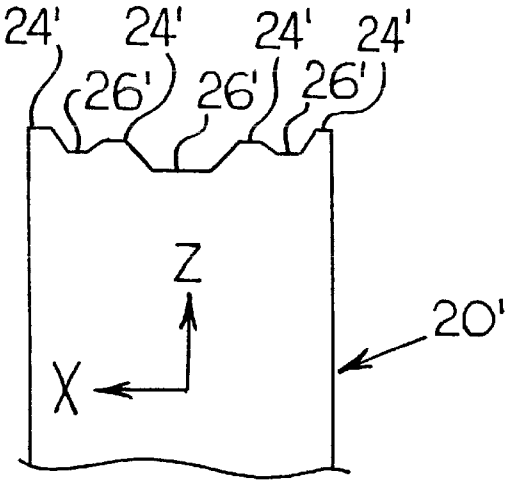
FIG. 17 is a top plan view of a slab shaped ingot having a slightly modified butt end formed according to the invention.
Figure 16:
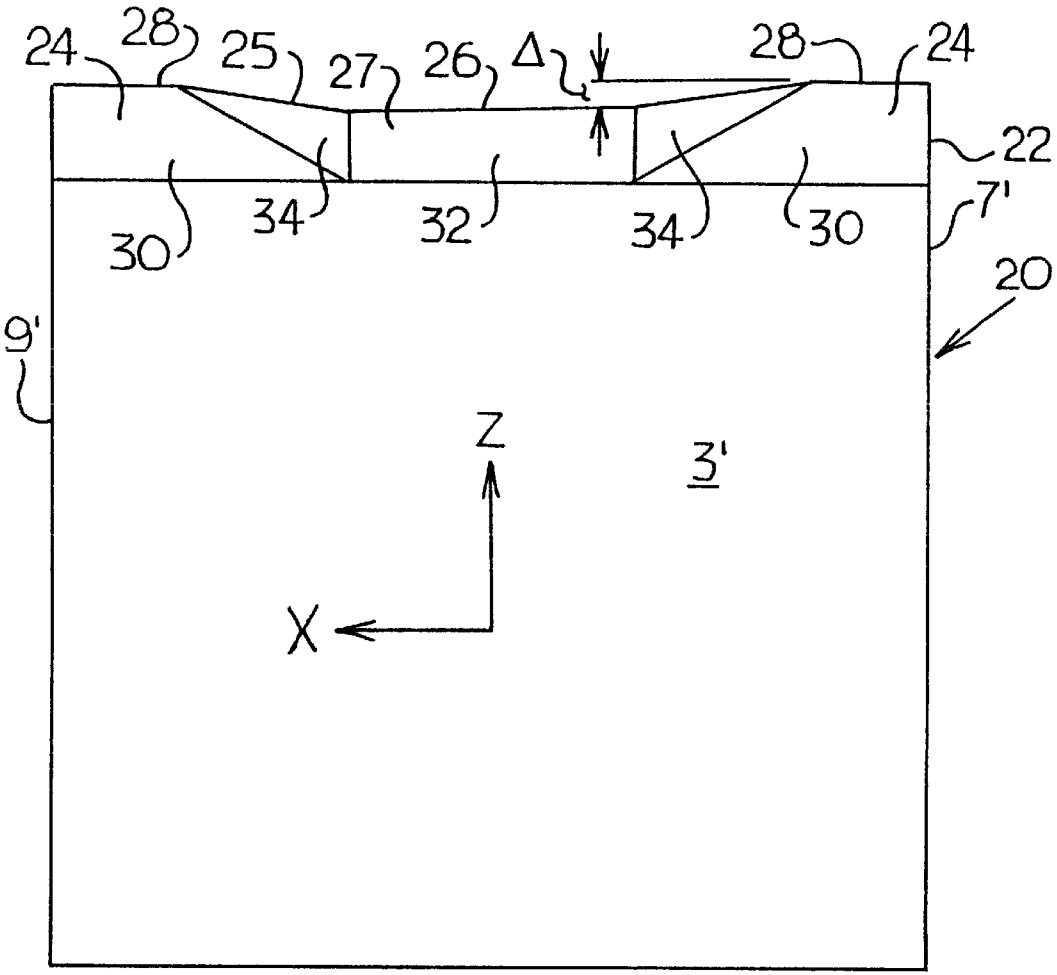
FIG. 16 is a plan view of the ingot of FIG. 13.

In one presently preferred embodiment of the present invention depicted in FIGS. 13–16, for an aluminum slab shaped ingot 20 measuring 48"×19" in the "X" and "Y" directions, respectively, the specially shaped butt end is dimensioned as follows. The face 28 of the enlarged portions 24 extends longitudinally outward in the "Z" direction about 1.5 inches ("Δ" or delta value) from the face 27 of the valley portion 26. The ingot end may contain more than two enlarged portions 24 and more than one valley portion 26, if desired, as shown in FIG. 17. In FIG. 17 the ingot 20' has four enlarged portions 24" and three valley portions 26' formed in the butt end thereof. In general, a "Δ" value is defined as the distance between the lowest location of all floors of the valley portions 26, 26' and the highest elevation of all of the peaks of the enlarged portions 24, 24'. This "Δ" or delta value, namely, the distance between the floor of the valley portion 26 and the outer face or peak 28 of the enlarged portions 24, can be important in controlling the formation of tongue deformation. The ingot end shape and its delta value help specify the widthwise ("X" direction) distribution of material volume available for this tongue deformation. This distribution removes material from the end of the slab to counteract the formation of the convex tongue 13 so as to form a substantially square slab end (in plan view) after rolling to some desired shearing thickness. Preferably, the delta value of the cast ingot 20 (or "$\Delta_{CI}$") ranges between about ½ inch to 2½ inches and, more preferably, between about 0.6 inch to 1½ inches and still more preferably between about 0.75 inch and 1¼ inches for aluminum ingots of this size (48"×19"). The "$\Delta_{CI}$" value is a function of starting slab ingot thickness, alloy, ingot reduction, mill capacity and shear design/shearing thickness. The length of the enlarged portions 24, i.e., the delta value, removes material in the middle of the slab to redistribute the metal to the ends of the slab to thus counteract the formation of the convex tongue 13 so as to form a substantially square end, in plan view after rolling. The delta value may vary depending upon process specifics including the alloy being rolled; the amount of draft taken in each slabbing roll pass; the mill's horsepower; roll speed; roll diameter; coolant and roll bite characteristics; the initial ingot thickness and the desired slab thickness at the required shearing pass.

Figure 15:
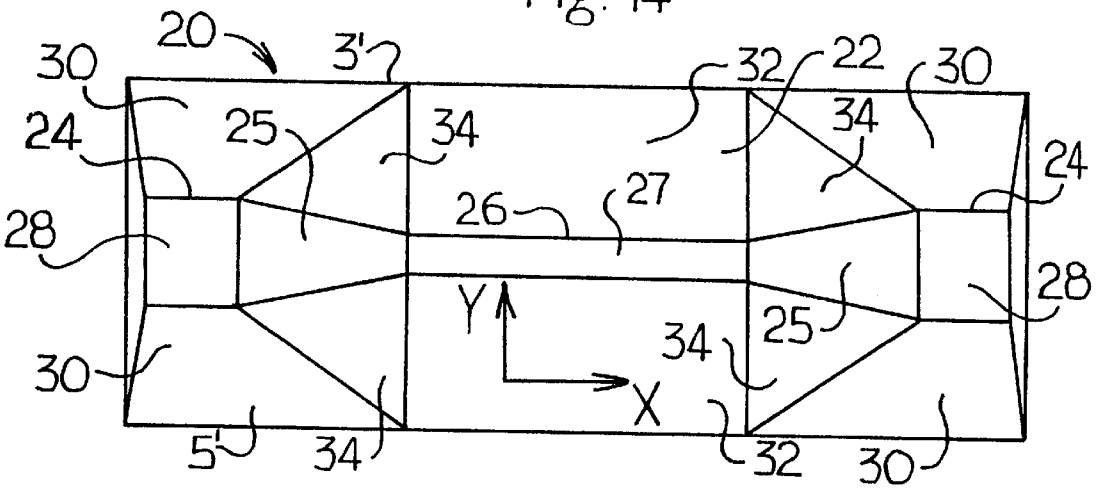
FIG. 15 is an end view of the specially shaped end geometry of the ingot of FIG. 13.

The length of the valley portion 26 in the "X" direction in this one presently preferred embodiment is about 15.5 inches, as measured between the lines of intersection between the intermediate sloped sections 25 and the end face 27 of the valley portion 26, FIG. 15. The width of the end face 27 in the "Y" direction as measured by the lines of intersection with the upper and lower transverse tapers 32 is about 2 inches. The end faces 28 of the enlarged portions 24 measure about 5 inches in the "Y" direction by about 6 inches in the "X" direction.

Figure 18:
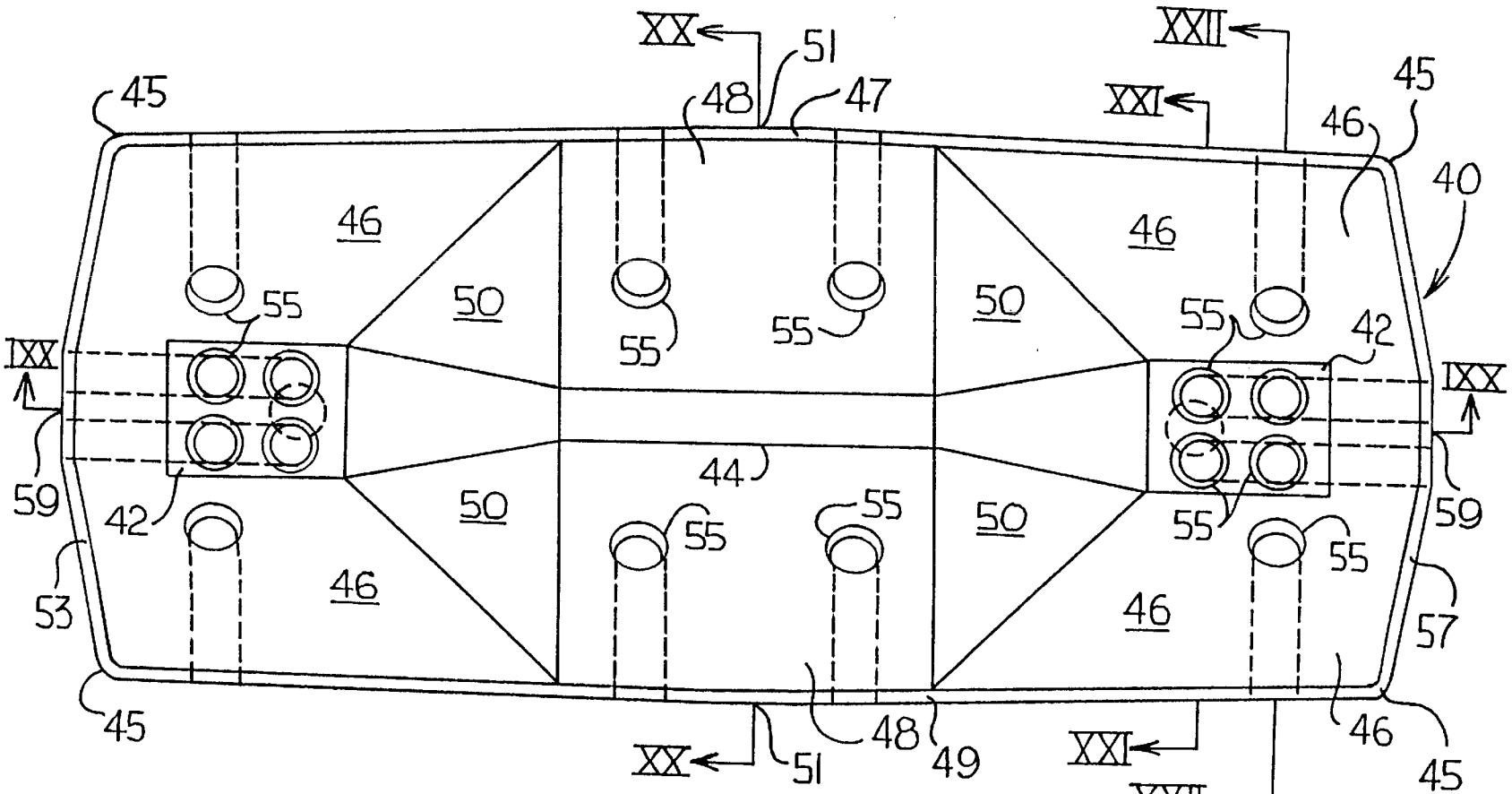
FIG. 18 is a top plan view of a presently preferred embodiment of a bottom block or starter block for use in casting a specially shaped end geometry of a slab ingot in accordance with the present invention.
Figure 19:
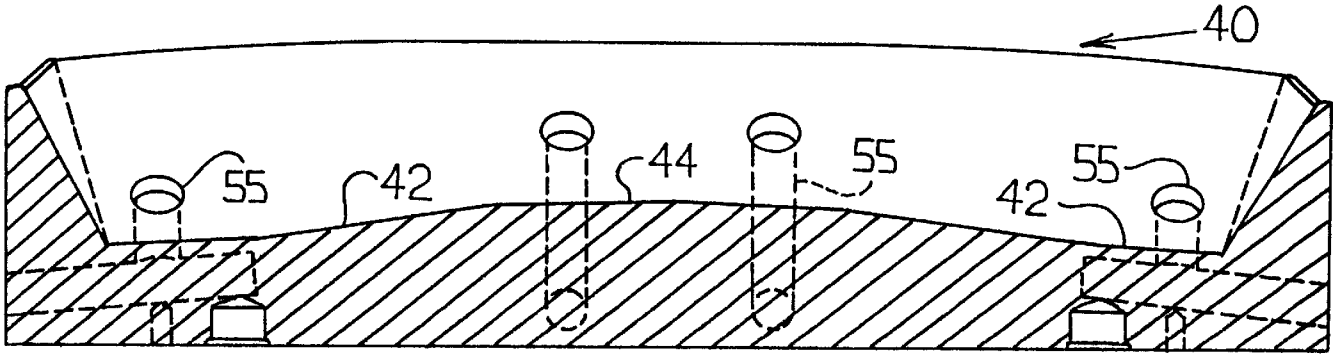
FIG. 19 is a cross-sectional view of the bottom block taken along section line IXX—IXX of FIG. 18.
Figure 20:
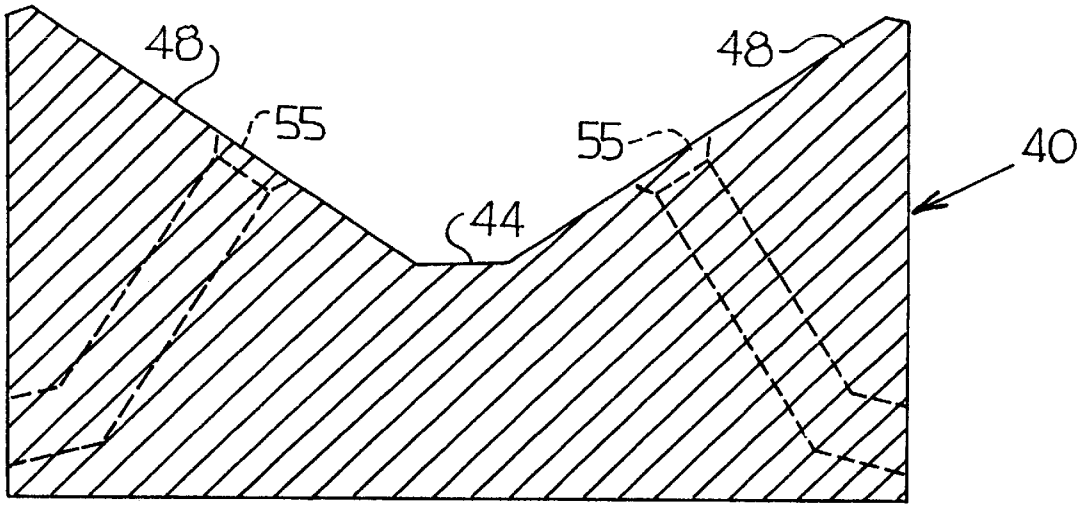
FIG. 20 is a cross-sectional view of the bottom block taken along section line XX—XX of FIG. 18.
Figure 21:
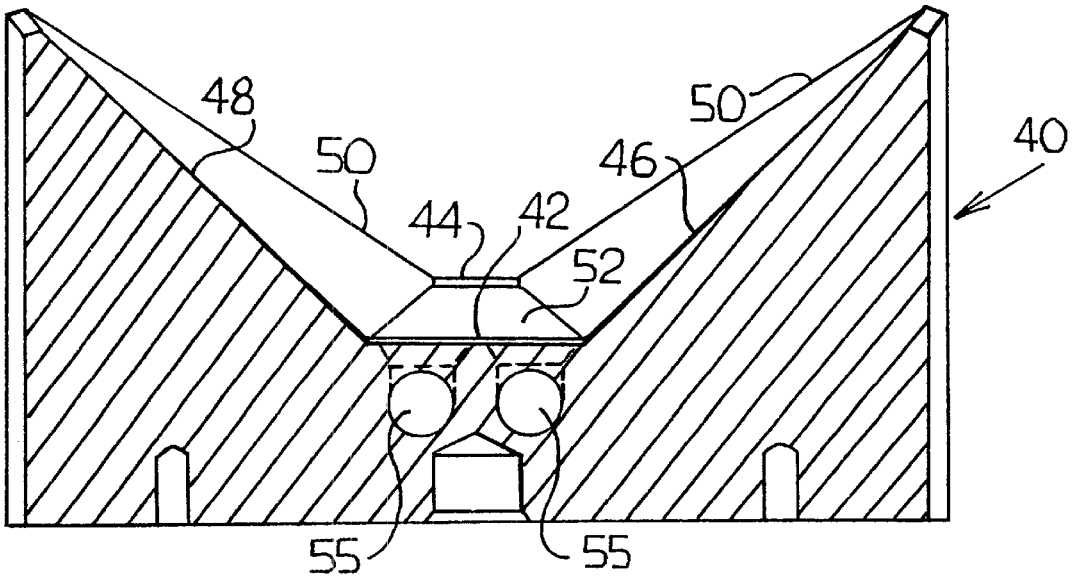
FIG. 21 is a cross-sectional view of the bottom block taken along section line XXI—XXI of FIG. 18.

One presently preferred embodiment of a bottom block 40 suitable for forming the special ingot end shape discussed above is depicted in FIGS. 18–23. Persons skilled in the art will readily understand the role of the bottom block or starter block in the DC (direct chill) casting of aluminum ingots. The bottom block 40 is generally rectangularly shaped in plan view, as shown in FIG. 18. The bottom block 40 is positioned in the open bottom portion of a similarly dimensioned rectangular mold (not shown) for casting a slab shaped ingot. Molten aluminum is then poured into the mold and solidifies in the bottom block 40 and thus assumes a cast configuration at its butt end approximating the shape of the bottom block 40. The bottom block 40 then slowly descends from the open bottom of the mold and the elongated cast slab shaped ingot is formed thereafter in a conventional manner.

Figure 9:
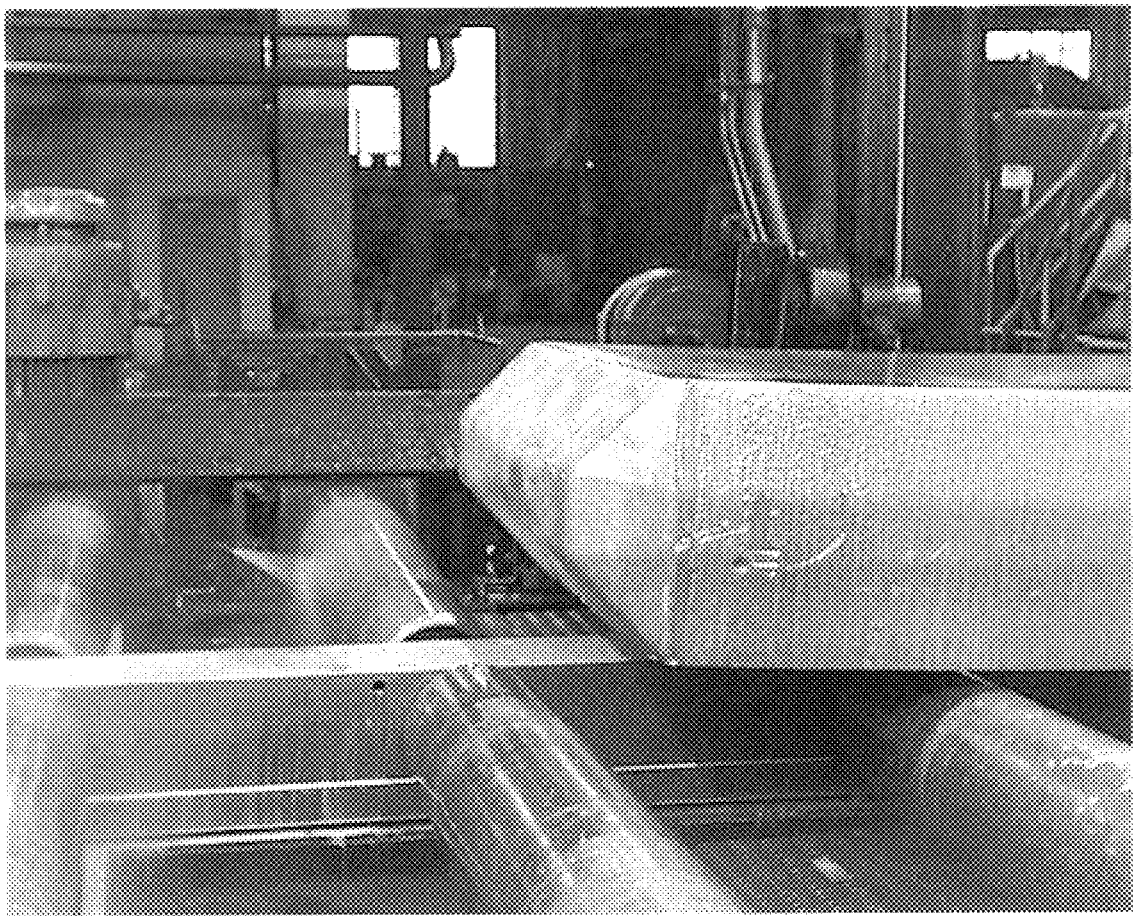
FIG. 9 is a photograph of the butt end of one of the ingots of FIG. 8 of the invention after one pass in a hot reversing mill.
Figure 10:
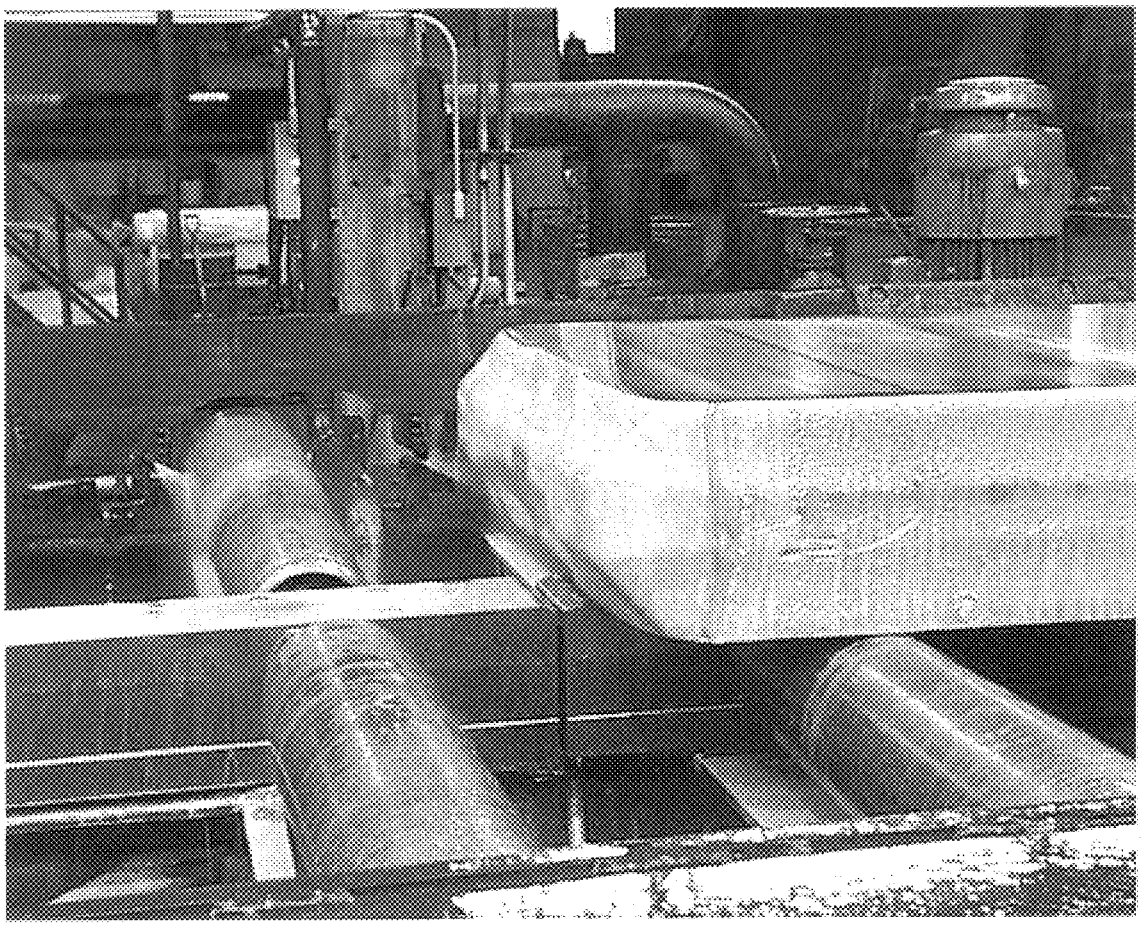
FIG. 10 is a photograph of the butt end of the ingot of FIGS. 8 and 9 of the present invention after three rolling passes in the hot reversing mill.
Figure 11:
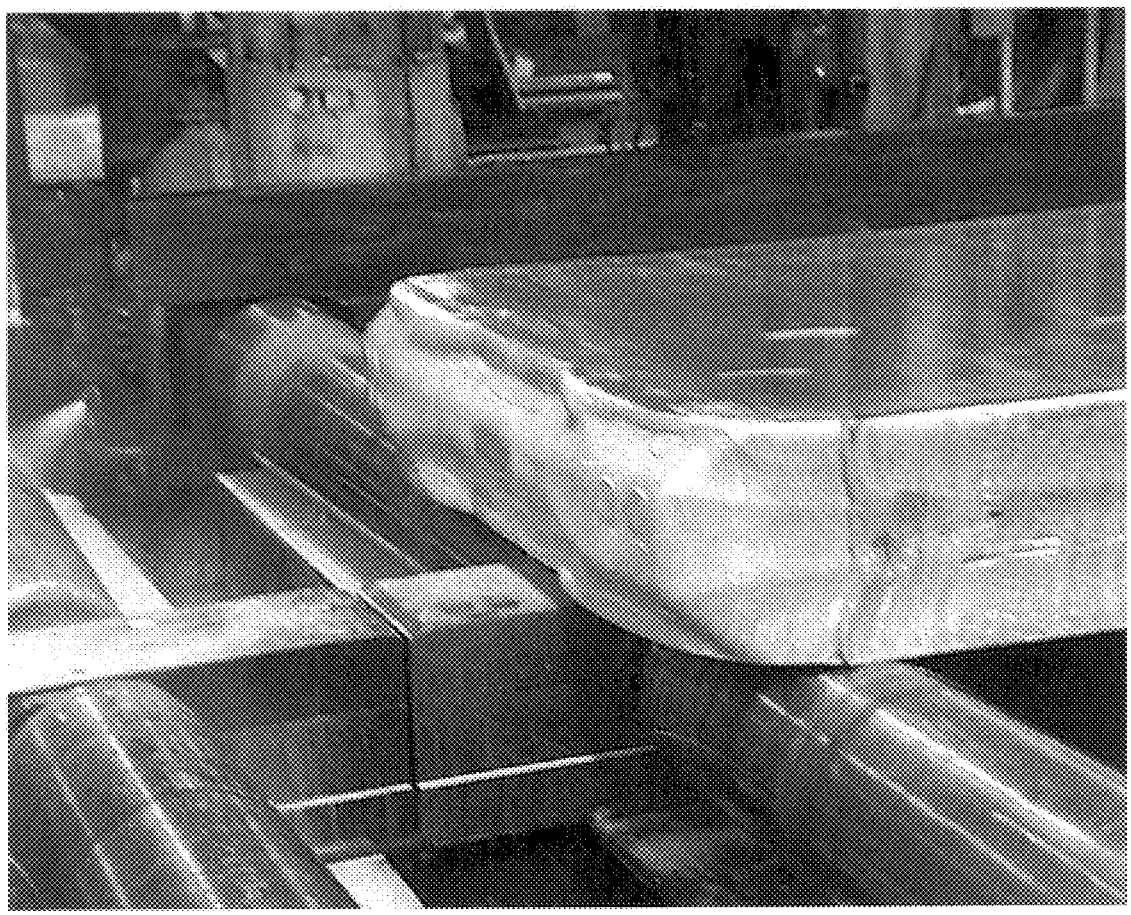
FIG. 11 is a photograph of the butt end of the ingot of FIGS. 8–10 of the present invention after five rolling passes.
Figure 12:
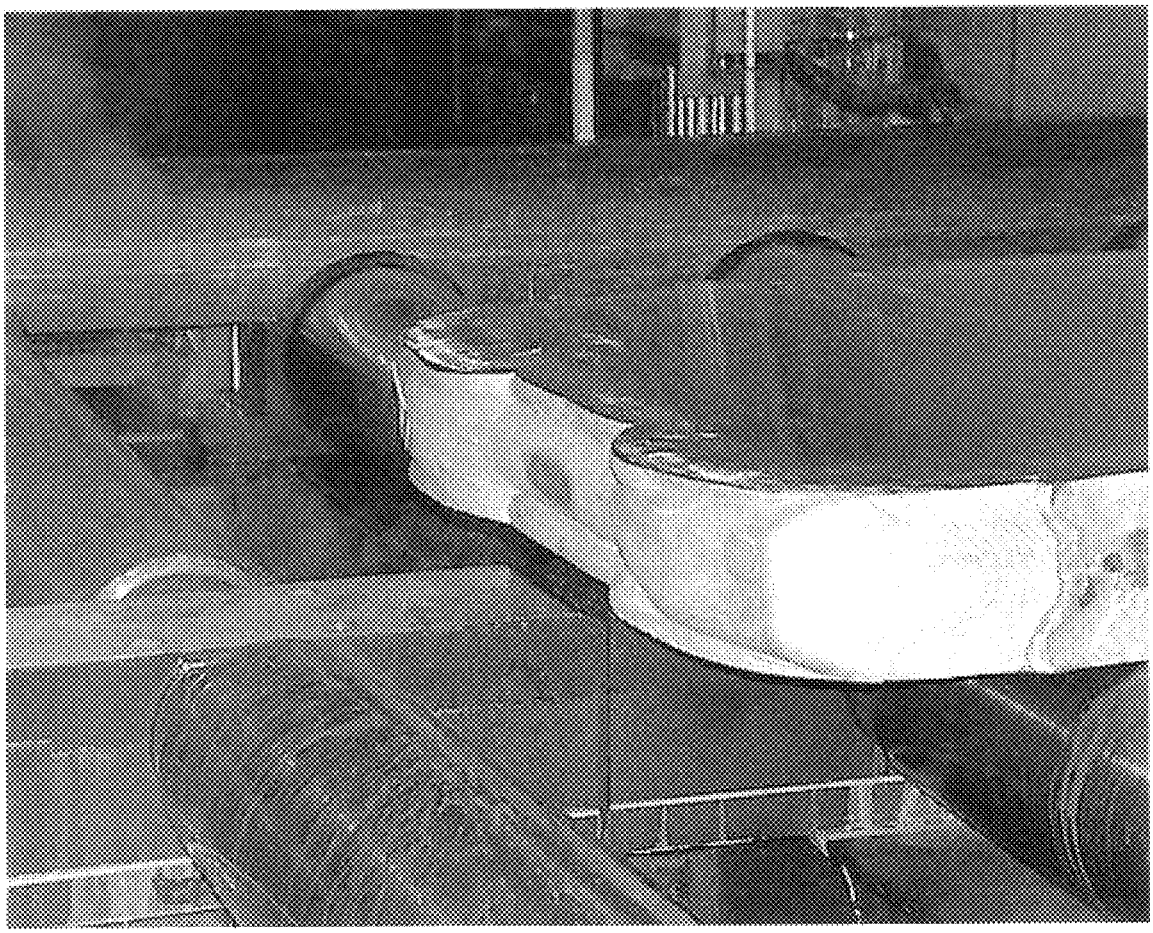
FIG. 12 is a photograph of the butt end of the ingot of FIGS. 8–11 of the invention after seven rolling passes.
Figure 13:
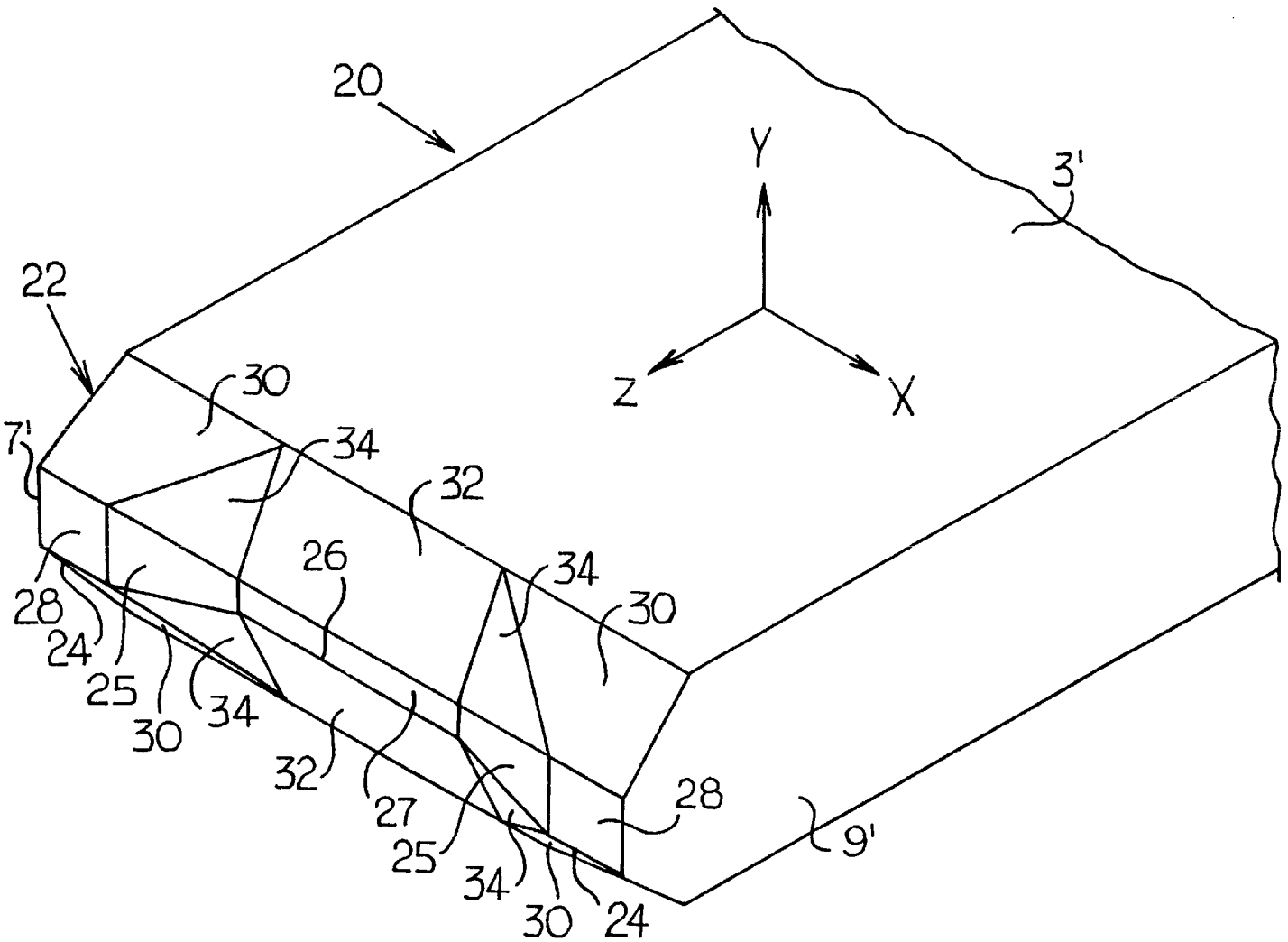
FIG. 13 is a perspective view of a partial slab shaped ingot having a specially shaped end geometry made according to the present invention.
Figure 14:
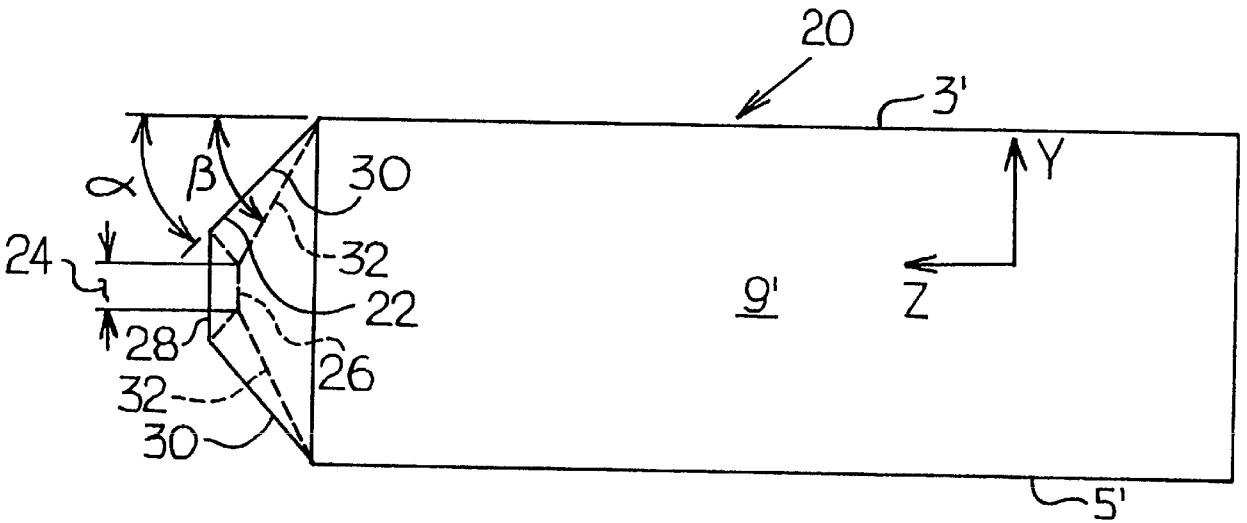
FIG. 14 is a side view of the ingot of FIG. 13.

Slab shaped ingots were cast using the bottom block 40 of the present invention to form the specially shaped butt end described above. The butt ends of two of such ingots are shown in the photograph reproduced in FIG. 8. The slab ingots depicted in FIG. 8 measured 20 inches thick ("Y" direction) by 49 inches wide ("X" direction). These ingots were cast from Aluminum Association type 3103 aluminum alloy. FIG. 9 shows one of these ingots at the butt end after one rolling pass in the same reversing roughing mill as used in processing the conventional slab ingots depicted in FIGS. 4–7. FIGS. 10, 11 and 12 show the specially shaped butt end of the invention after the $3^{rd}$, $5^{th}$ and $7^{th}$ rolling passes, respectively. A comparison between FIGS. 7 and 12 shows that the present invention substantially eliminates the tongue and overlap rolling deformations present in the conventionally formed slab ingot.

In practice, it was possible to continue rolling the slab depicted in FIG. 12 without cropping after the $7^{th}$ pass due to the substantial lack of tongue and overlap. The slab of FIG. 12 was rolled for five additional passes down to the desired one inch thickness without the need for any intermediate cropping and with increased rolling mill efficiency. The following table illustrates the material savings realized by the present invention. The table shows the amount of butt end crop savings provided by the specially shaped ingot of the present invention over conventionally cast ingots rolled to a 5.5 inch thick slab. Material savings ranging from 300 pounds to almost 900 pounds per slab ingot are achieved, representing a material recovery gain of from 1.2% to 3.5% in the various ingot sizes listed in the table. In high throughput mills, this savings represents a significant improvement in the overall economics of the manufacturing operations.

TABLE 1

PER BLOCK END CROP SAVINGS*

| Ingot Sample No.** | Pounds saved | Recovery Gain on a 25,000 lb. ingot | Recovery Gain on a 35,000 lb. Ingot |
|---|---|---|---|
| 1 | 300 | 1.2% | 0.9% |
| 2 | 335 | 1.3% | 1.0% |
| 3 | 500 | 2.0% | 1.4% |
| 4 | 580 | 2.3% | 1.7% |
| 5 | 620 | 2.5% | 1.8% |
| 6 | 330 | 1.3% | 0.9% |
| 7 | 390 | 1.6% | 1.1% |
| 8 | 585 | 2.3% | 1.7% |
| 9 | 590 | 2.4% | 1.7% |
| 10 | 675 | 2.7% | 1.9% |
| 11 | 740 | 3.0% | 2.1% |
| 12 | 870 | 3.5% | 2.5% |

*Savings are based on an approximate 4"–6" thick scrap cut at the shear.
**Ingot sizes varied from about 20" × 43" up to 24" × 78"

As can be seen in the drawings of one presently preferred embodiment of bottom block 40 of FIGS. 18–23, particularly the cross-sectional views of FIGS. 19–22, the bottom block 40 contains a deeply depressed cavity for forming the special end geometry on the slab ingot. The depressed cavity comprises deeply cut portions 42 for forming the enlarged portions 24 and a less deeply cut intermediate portion 44 for forming the depressed valley portion 26 on the butt end of the slab ingot. Those skilled in the art will readily understand and appreciate that the solidified metal shell, particularly aluminum, will shrink and curl away from the mold and bottom block. It is also known that some aluminum alloys shrink more than others. The bottom block is dimensioned to compensate for edge curl, which causes the solidifying metal to move away from the bottom block edges, at deeply cut portions 42, a greater distance than at the intermediate portion 44. Thus, the deeply cut portions 42 are made slightly longer to compensate for the edge curl (or greater shrinkage) occurring at the deeply cut portions 42. Typically, about 1 to 2½ inches are added to the cast ingot delta value in the machined bottom block 40 to achieve a desired delta value in a cast ingot. For example, if a delta of 1 inch is desired in the cast ingot ("$\Delta_{CI}$"), then a delta in the bottom block ("$\Delta_{BB}$") of about 3 inches is provided, assuming a butt curl or shrinkage of 2 inches. As noted above, persons skilled in the art also know that the amount of butt curl in aluminum alloy varies with the alloy and cross-sectional size. For example, a 5000 series aluminum alloy may have 2 inches of butt curl during casting while an 1100 series aluminum alloy for the same size ingot will have a butt curl of about 1½ inches. Thus, the type of alloy being cast and its shrinkage/curl characteristics must also be taken into account when forming the bottom block 40.

Figure 22:
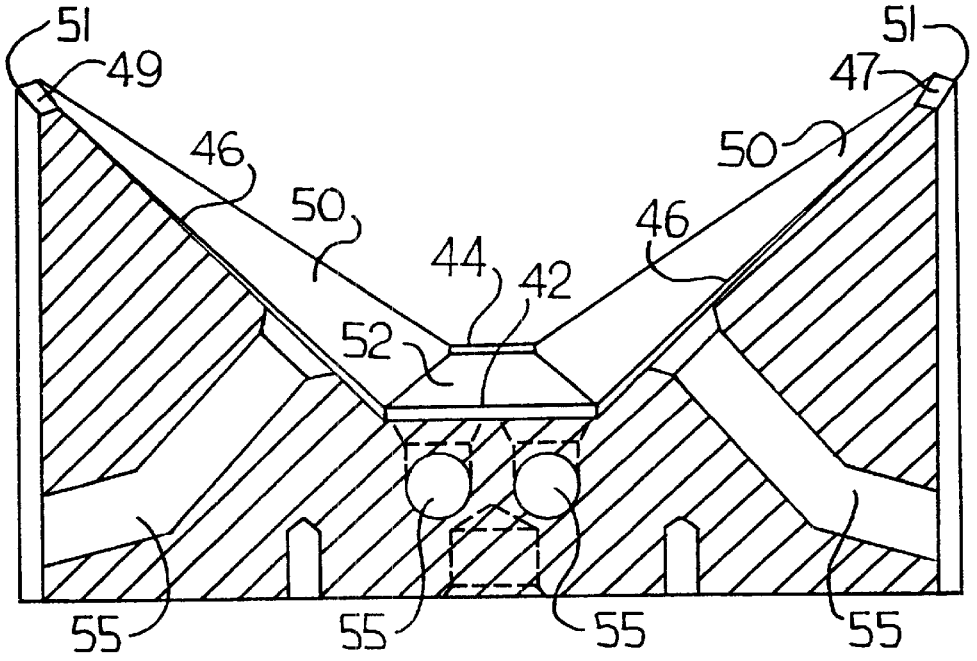
FIG. 22 is a cross-sectional view of the bottom block taken along section line XXII—XXII of FIG. 18.
Figures 23, 24:
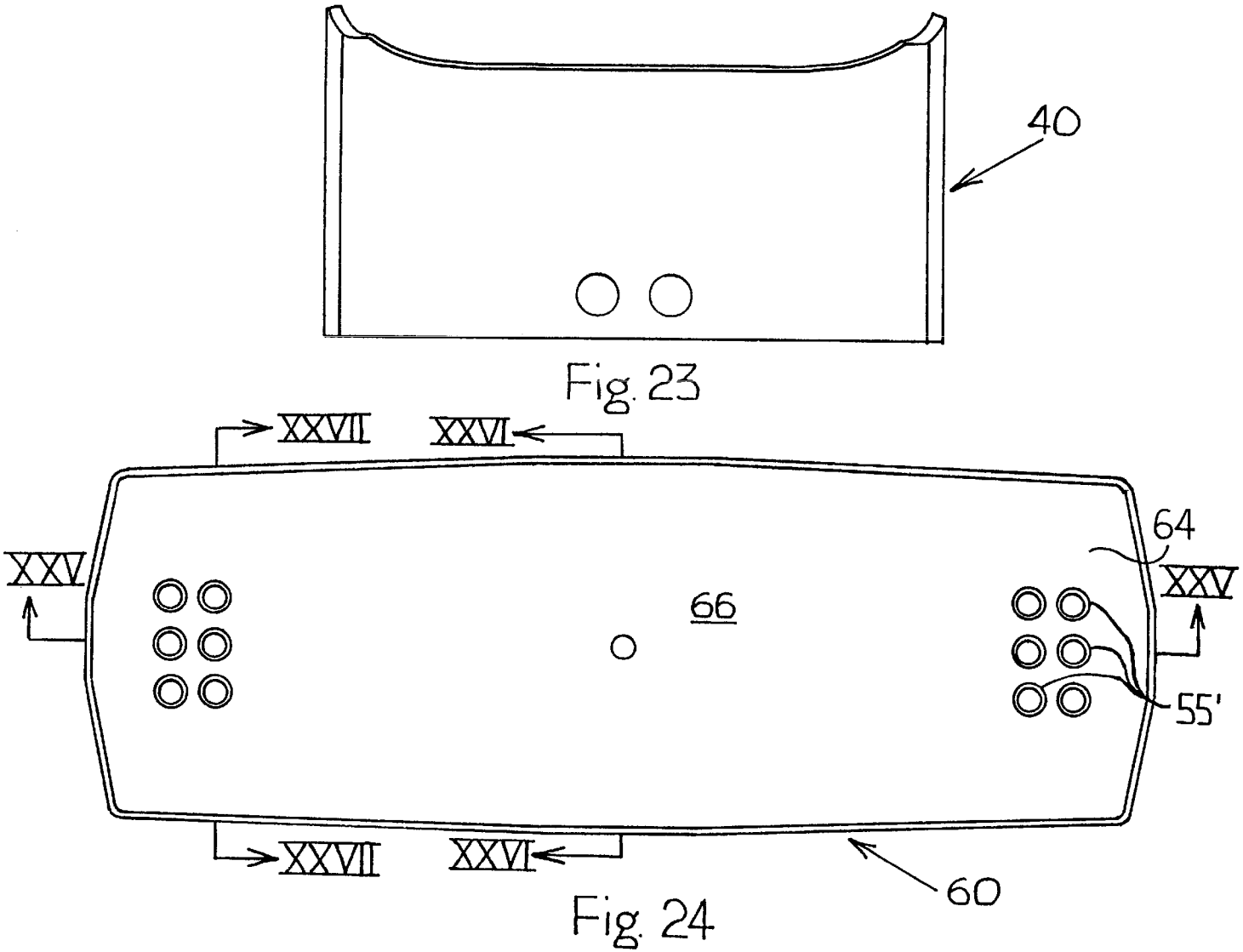
FIG. 23 is an end view of the bottom block of FIG. 18.
FIG. 24 is a top plan view of a further preferred embodiment of a bottom block for use in casting a specially shaped end geometry of a slab ingot in accordance with the present invention.
Figure 25:
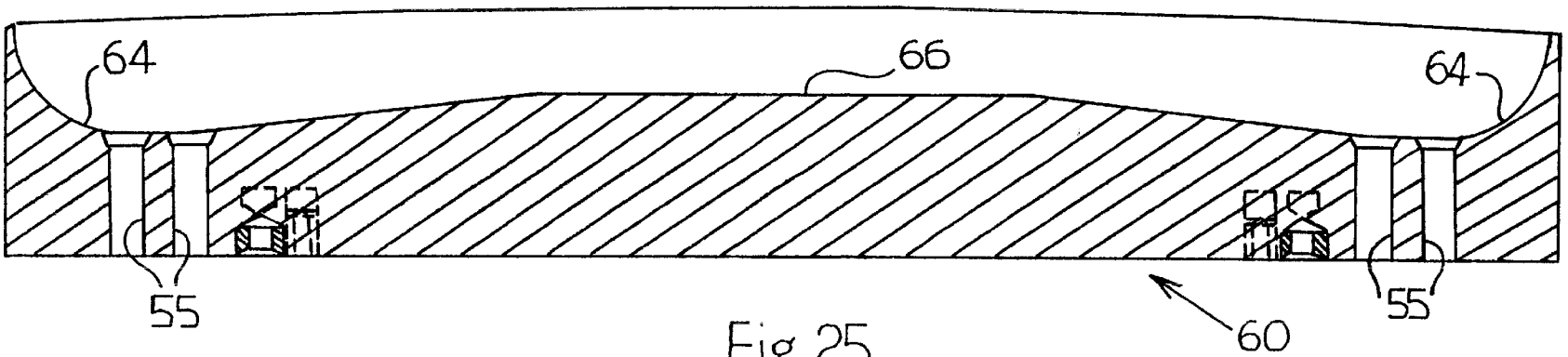
FIG. 25 is a cross-sectional side view of the bottom block taken along section line XXV—XXV of FIG. 24.
Figure 26:
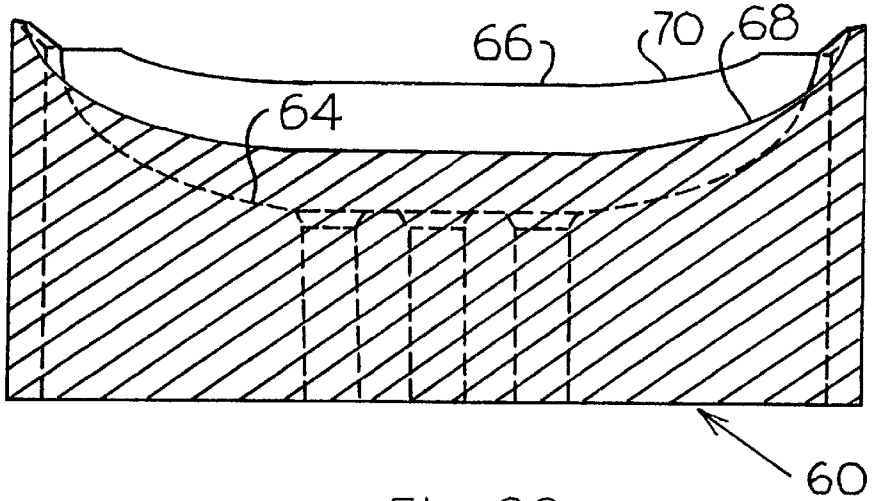
FIG. 26 is a cross-sectional view of the bottom block taken along section line XXVI—XXVI of FIG. 24.
Figure 27:
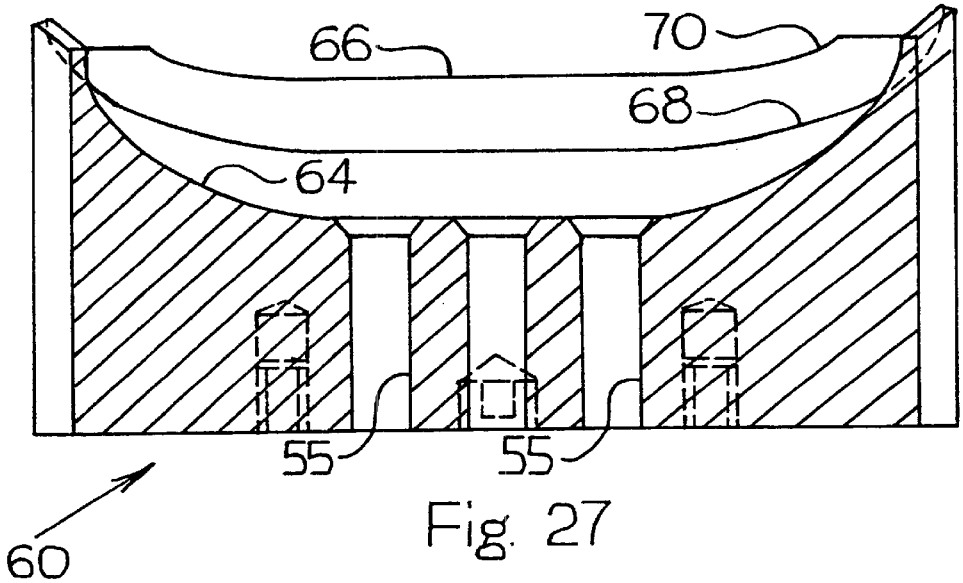
FIG. 27 is a cross-sectional view of the bottom block taken along section line XXVII—XXVII of FIG. 24.

As can be seen in the plan view of the bottom block 40 in FIG. 18, as well as in the cross-sectional view of FIG. 22, the long sides 47 and 49 of the bottom block which define the upper and lower rolling faces 3' and 5' of the ingot are formed as a continuous outwardly extending convex curve from the corners 45 to the mid point 51 of the transverse centerline of the bottom block, coinciding with section line XX×XX of FIG. 18. The convexly curved surfaces defined by the sides 47 and 49 negate the effect of curl or metal shrinkage across the rolling faces of the ingot to provide a flat rolling face after ingot solidification. Presently, in a 3½ foot wide ingot size, a convex curvature on the order of about 1 inch in each of bottom block sides 47 and 49 is sufficient to negate the effect of curl across the rolling faces. Of course, the magnitude of the convex curve for the sides 47 and 49 would be increased for wider ingot where a greater amount of curl is realized. In addition, the gage face sides 53 and 57 of the bottom block 40 are also formed in a like manner, with an outwardly extending convex curved shape to negate the effect of gage face edge curl during casting. The gage face sides 53 and 57 of the bottom block 40 curve outwardly in a convex manner from the corners 45 of the bottom block to the mid point 59 of the longitudinal centerline of the bottom block, coinciding with section line IXX×IXX of FIG. 18. The curved gage face minimizes the edge rolling alligatoring of the slab and minimizes the crop losses.

The bottom block 40 also has downwardly sloping sidewalls 46 and 48 for forming the respective transverse tapers 30 and 32 on the ingot and further includes downwardly sloping surfaces 50 to form the upper and lower tapered faces 34 in the ingot. The bottom block 40 also has an upwardly sloping trapezoidal surface 52 extending from the bottom face of the deeply cut end portion 42 to the surface of the intermediate portion 44 to form the intermediate sloped section 25 in the cast ingot.

The bottom block 40 also has a plurality of conventional bore holes 55 formed therein to communicate with various portions of the cavity thereof at one end and with the exterior of the block at the other end. The bore holes 55 permit cooling water from the DC casting operation to drain from the bottom block cavities and minimize the possibility of a molten metal steam explosion in the event of an ingot bleedout or molten metal spill into the bottom block.

It will be understood by those skilled in the art that while the bottom block 40 depicted in the drawings includes machined surfaces that are cut in flat, facet-like surfaces, alternate configurations may be employed, such as a more rounded or curved (non-faceted) geometry, or multi-faceted geometry, for example. A smoothly-curved, "dog-bone" like configuration is another presently preferred alternative embodiment of the bottom block shape, one producing an ingot having greater material mass at the transverse edges of the slab with either flat or radiused upper and lower transverse tapers, so as to achieve the objects of the present invention. An example of such a modified bottom block 60 in accordance with the present invention is shown in FIGS. 24–27. The bottom block 60 has a cavity 62 which is formed by a continuously radiused or elliptical surface to form the more deeply cut end portions 64 and the less deeply cut intermediate portion 66, as well as the radiused surfaces 68 and 70 for forming the double transverse tapers. For these shapes, the side profile is more elliptical where the angle varies from zero at the rolling surface to 90° at the valley flat portion. Thus, it is the shape and not the angle, per se, that is relevant for non-faceted shapes.

The present invention is suitable for use in casting or otherwise shaping (by machining) metal ingots which are customarily rolled into flat sheet or plate from a slab shaped ingot. Metals such as steel, copper, titanium and particularly aluminum and its alloys are of interest. With respect to aluminum, the invention is useful in the casting of 1000, 2000, 3000, 4000, 5000, 6000, 7000 and 8000 series (Aluminum Association) alloys. Of particular interest are the 1000, 3000, 5000 and 6000 series of aluminum alloys. Also of interest are the 2000 and 7000 series aluminum alloys wherein the slabs are rolled to plate and sheet structural products for use in aerospace applications.

Figure 28:
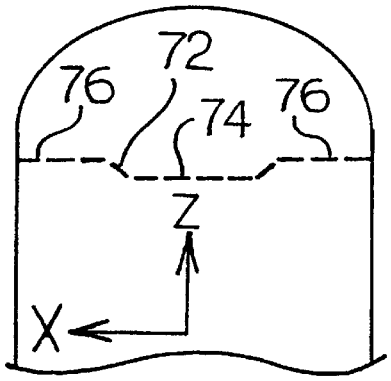
FIG. 28 is a fragmentary plan view of a previously rolled slab showing a special crop shear profile according to the present invention.

A process variation according to the present invention may optionally include an intermediate slab shearing or cropping step in which the rolled slab after, for example, 7 to 10 rolling passes has its ends cropped by a specially configured shear. The crop shear has a special profile 72 as shown in FIG. 28. The special profile 72 provides a cropped slab end having, in plan view, a depressed central valley portion 74 and outwardly enlarged end portions 76. The special sheared profile 72 thus minimizes tongue formation upon further rolling of the slab after cropping.

The specially shaped ingot end of the present invention as discussed herein is preferably formed during ingot casting, particularly at the butt end of the ingot by way of the specially shaped bottom block 40 (faceted shape) or bottom block 60 (rounded, dog-bone shape). The head end of the ingot may also be specially shaped to assume a shape substantially the same as the butt end through the use of a similarly shaped hot top mold which is positioned above the mold and filled with molten metal at the conclusion of the casting run. Alternatively, the special shape at the head end can be formed by machining to duplicate or approximate the shape of the ingot end depicted in FIGS. 13–17. One or both ends of the ingot could also be formed by a forge or press using dies of the desired configuration. For example, a forge or press of suitable capacity may be fitted with a pair of tapered dies to deform one or both ends of a slab ingot into a double tapered configuration.

Figure 29:
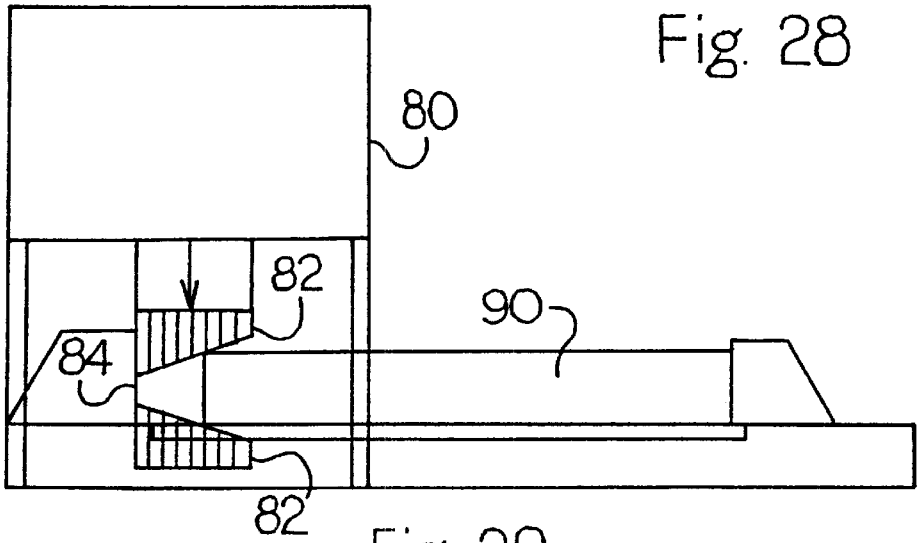
FIG. 29 is a simplified, side elevation view of a forge press mechanism for forming a special shape on the end of an ingot in accordance with the invention.
Figure 30A:
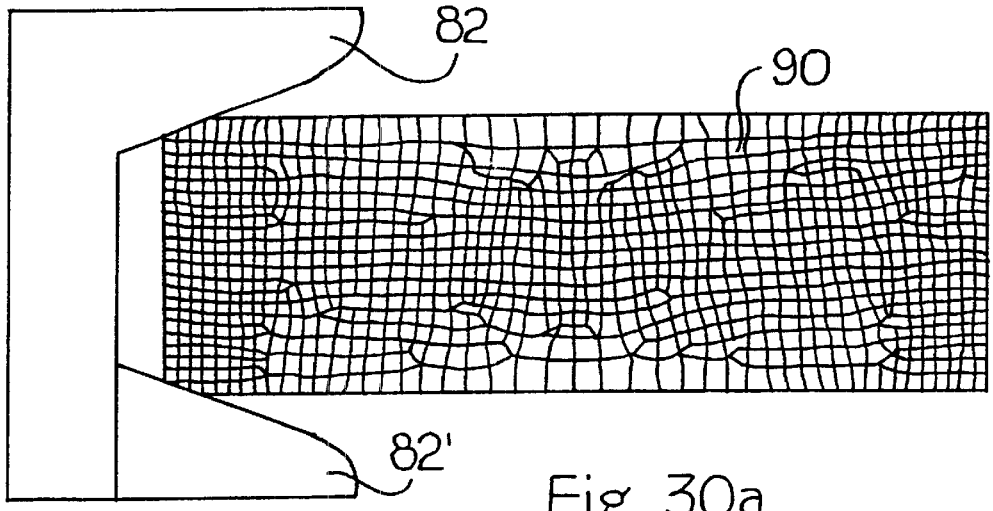
FIGS. 30(*a*)–30(*f*) are simplified partial side elevation views of a pair of tapered dies and an ingot, sequentially depicting the operation of a press mechanism similar to that of FIG. 29 used in forming a double transverse taper on an ingot in accordance with the present invention.
Figure 30B:
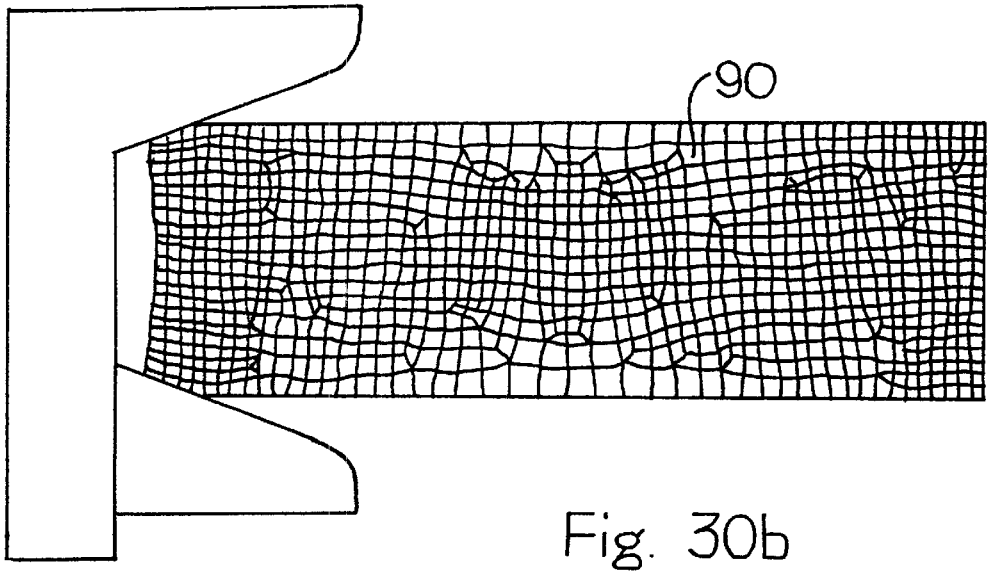
Figure 30C:
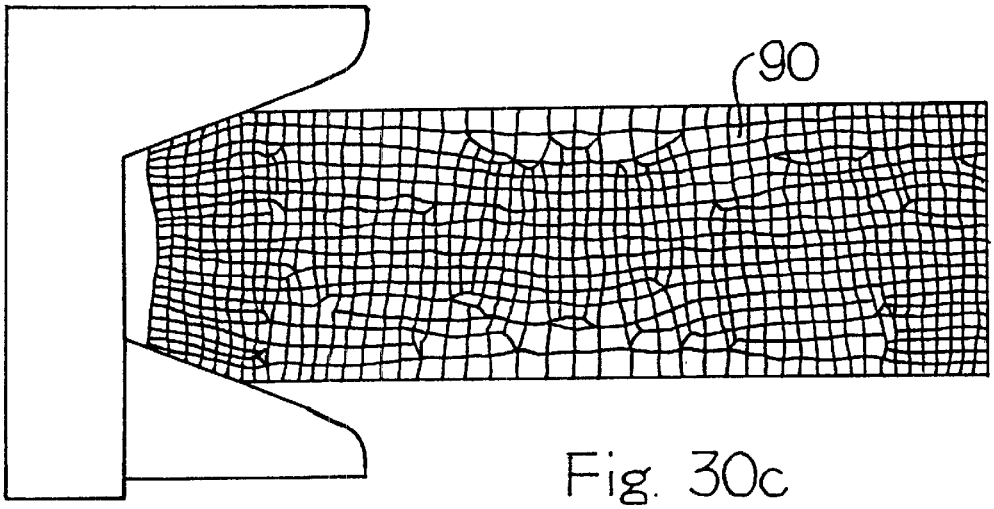
Figure 30D:
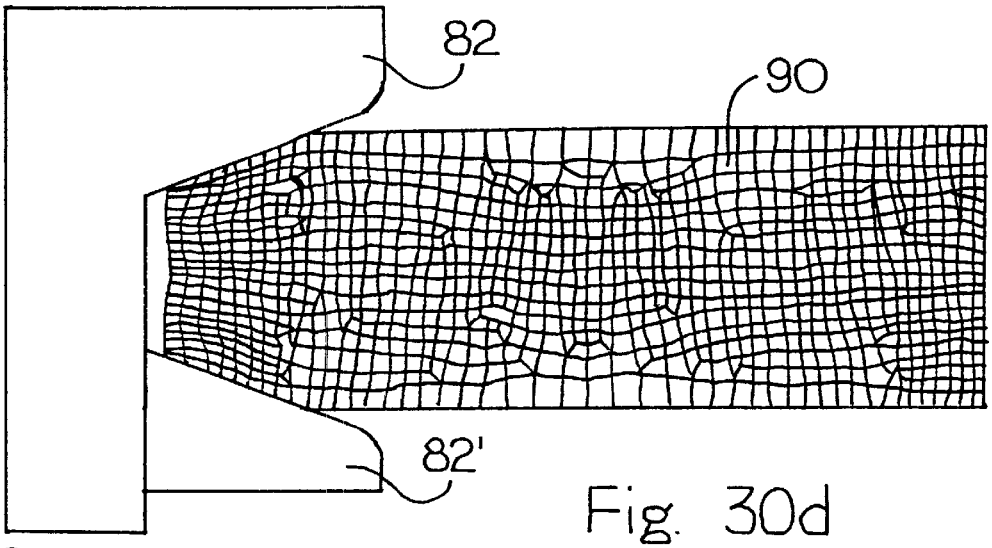
Figure 30E:
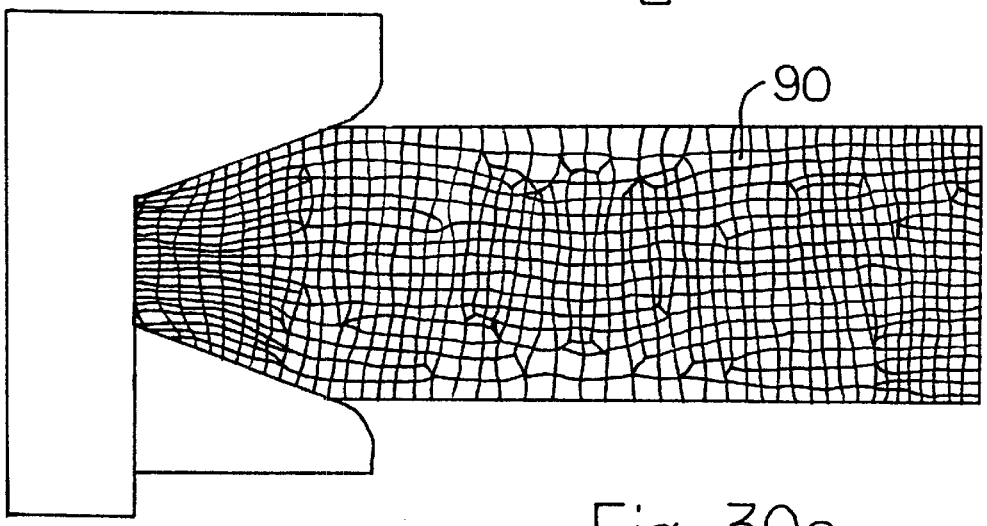
Figure 30F:
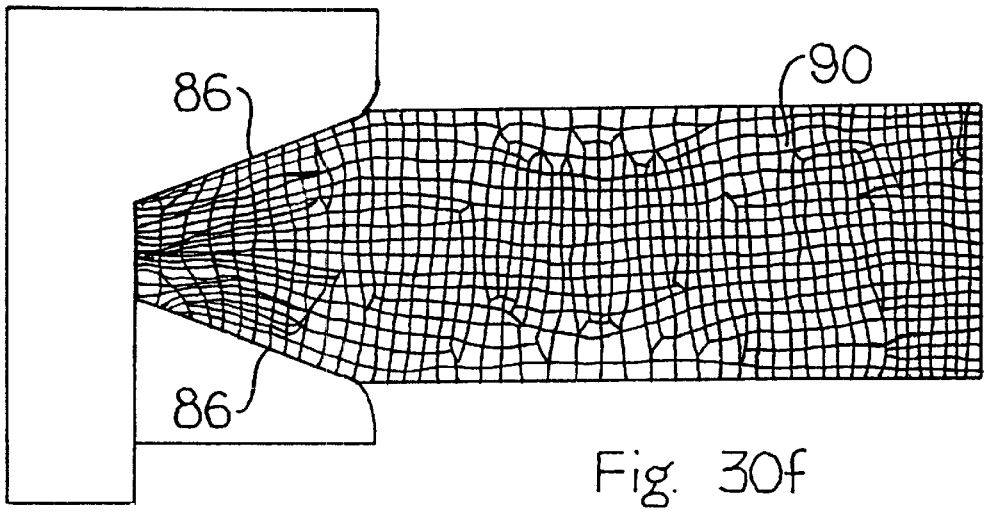

Apparatus for forming the double tapered shape to the ingot is depicted in FIGS. 29 to 30. A press or forging press apparatus 80 is shown in FIG. 29 having a pair of tapered dies 82 for forming transverse tapers to the head end and/or the butt end of the ingot, for example. A hydraulic press having a capacity of 900 tons is suitable for forming the tapers in an aluminum ingot. Preferably, the ingot is heated to a temperature of 850°–950° F. before forming the tapers.

FIGS. 30(*a*)–30(*f*) sequentially depict the mechanical forming operation wherein a double transverse taper is formed at an end of a slab shaped ingot 90 by a hydraulic forge press, of the type shown in FIG. 29. In the schematic of FIGS. 30(*a*)–30(*f*) the endstop 84, is part of the top die 82, wherein the lower die is designated 82'. The ingot 90 of this example is 21 inches in thickness and 50 inches wide, and the finished end form shown in FIG. 30(*f*) has a vertical flat at the end of the taper of 7 inches and the length of the upper and lower tapers 86 of about 16 inches. The taper angle of the tapers, as well as the dies 82, 82' is about 25° (from horizontal). The table below estimates the peak load required of the hydraulic forge press for forming the double transverse end taper on a 50 inch wide 3XXX series aluminum alloy ingot in one stroke of the press, at 0.1 inch/second and at 1.0 inch/second ram speed at an ingot temperature of 850° F. and at 950° F.

TABLE 2

| Loads for Full 50" Wide 3XXX Ingot | | |
|---|---|---|
| | 0.1 in/sec (100 sec) | 1.0 in/sec (10 sec) |
| 850° F. | 1375 tons | 2250 tons |
| 950° F. | 900 tons | 1500 tons |

The peak loads reported above in the table can be reduced if a smaller dimensional die is used. For example, in the above table, it is assumed that 50 inch wide dies are used so as to deform the entire width of the ingot in one press stroke. The same end shape can be obtained at a lower hydraulic load if the length of the dies is decreased. For example, if the tapered dies are 10 inches wide, the ingot end could be formed by making five upsetting bites of 10 inches each to traverse the width of the ingot. This should only require 20% of the peak loads shown in the above table.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

We claim:

1. A method for reducing end crop losses in rolling metal ingots comprising the steps of:

(a) providing an ingot having at least one shaped end extending in a direction transverse to a rolling direction, wherein said shaped end has at least two enlarged portions extending longitudinally in the rolling direction and positioned at opposed, transversely spaced-apart locations adjacent to opposed edge faces of the ingot, said enlarged portions having a valley region of reduced longitudinal dimension therebetween, defined by a dimension "Δ"; said at least one ingot shaped end also including upper and lower tapers extending in a direction transverse to the rolling direction across a width of said ingot, respectively, from an upper rolling face and a lower rolling face of said ingot across said enlarged portions and across said valley region; and (b) conducting a plurality of rolling passes on said ingot to reduce a thickness thereof and elongate said ingot, wherein said longitudinally extending enlarged portions and said transversely extending upper and lower tapers minimize the formation of overlap/lamination and tongue conditions, respectively, at the shaped end of the ingot, whereby end crop losses caused by said conditions are reduced.

2. The method of claim 1 wherein at least one of the shaped ends of the ingot is a butt end which is formed during ingot casting by way of a shaped bottom block.

3. The method of claim 1 wherein at least one of the shaped ends of the ingot is formed after ingot casting by a machining prior to rolling.

4. The method of claim 1 wherein both a butt end and a head end of the ingot are each provided with a shaped end, wherein at least the shaped end at the butt end is formed during ingot casting by way of a shaped bottom block.

5. The method of claim 4 wherein the shaped end at the head end of the ingot is formed by one of casting, machining, rolling or forging.

6. The method of claim 1 wherein the dimension "Δ" of the shaped ingot end is between about ½ to 2½ inches.

7. The method of claim 1 wherein the transverse tapers extending across the enlarged portions are formed at an angle "α" defined by an angle developed between a plane of a rolling face of the ingot and a plane passing through the transverse tapers on the enlarged portions and wherein said angle "α" is between about 30° and 70°, and wherein the transverse tapers extending across the valley region are formed at an angle "β" defined by an angle developed between the plane of the rolling face and a plane passing through the transverse tapers on the valley region and wherein said angle "β" is between about 30° and 70°.

8. A method for reducing end crop losses in rolling metal ingots comprising the steps of:

(a) providing an ingot having at least one shaped end, wherein said shaped end has at least two longitudinally outwardly extending, enlarged portions at opposed, transversely spaced-apart locations adjacent to opposed edge faces of the ingot and having a valley region of reduced longitudinal dimension therebetween, defined by a dimension "A"; said at least one ingot shaped end also including upper and lower tapers transversely extending across a width of said ingot, respectively, from an upper rolling face and a lower rolling face of said ingot across said enlarged portions and across said valley region, wherein the transverse tapers extending across the enlarged portions are formed at an angle α defined by an angle developed between a plate of a rolling face of the ingot and a plane passing through the transverse tapers on the enlarged portions and wherein said angle "α" is between about 30° and 70°, and wherein the transverse tapers extending across the valley region are formed at an angle "β" defined by an angle developed between the plane of the rolling face and a plane passing through the transverse tapers on the valley region and wherein said angle "β" is between about 30° and 70°; and (b) conducting a plurality of rolling passes on said slab ingot to reduce a thickness thereof and elongate said ingot, wherein said outwardly extending end portions and said transversely extending tapers minimize the formation of overlap/lamination and tongue conditions, respectively, whereby crop losses caused by said conditions are reduced.

* * * * *

UNITED STATES PATENT AND TRADEMARK OFFICE

CERTIFICATE OF CORRECTION

PATENT NO. : 6,453,712 B1 
DATED : September 24, 2002
INVENTOR(S) : Lawrence E. Klosterman et al.

It is certified that error appears in the above-identified patent and that said Letters Patent is hereby corrected as shown below:

Column 14,
Line 32, insert -- Δ -- delete "A".

Signed and Sealed this

Eighteenth Day of October, 2005

JON W. DUDAS
*Director of the United States Patent and Trademark Office*